US011414802B2

(12) United States Patent
Lee et al.

(10) Patent No.: US 11,414,802 B2
(45) Date of Patent: Aug. 16, 2022

(54) LAUNDRY TREATING APPARATUS

(71) Applicant: LG Electronics Inc., Seoul (KR)

(72) Inventors: HyeonSik Lee, Seoul (KR); Junyoung Kim, Seoul (KR); Hong Min Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 147 days.

(21) Appl. No.: 16/775,702

(22) Filed: Jan. 29, 2020

(65) Prior Publication Data

US 2020/0248364 A1 Aug. 6, 2020

(30) Foreign Application Priority Data

Feb. 1, 2019 (KR) ..... 10-2019-0013926
Oct. 29, 2019 (KR) ..... 10-2019-0135459

(51) Int. Cl.
*D06F 37/06* (2006.01)
*D06F 23/02* (2006.01)
(Continued)

(52) U.S. Cl.
CPC ..... *D06F 37/06* (2013.01); *D06F 21/02* (2013.01); *D06F 23/02* (2013.01); *D06F 37/04* (2013.01); *D06F 21/10* (2013.01); *D06F 37/065* (2013.01)

(58) Field of Classification Search
CPC ..... D06F 21/02; D06F 21/10; D06F 37/04; D06F 37/06; D06F 37/065; D06F 23/02
See application file for complete search history.

(56) References Cited

U.S. PATENT DOCUMENTS 1,389,182 A * 8/1921 Binder ..... D06F 37/06 68/142
5,318,705 A 6/1994 Pellerin
(Continued)

FOREIGN PATENT DOCUMENTS

CN 1414163 4/2003
CN 1576443 2/2005
(Continued)

OTHER PUBLICATIONS

JP Office Action in Japanese Appln. No. 2019-237648, dated Dec. 1, 2020, 6 pages (with English translation).
(Continued)

*Primary Examiner* — Joseph L. Perrin
(74) *Attorney, Agent, or Firm* — Fish & Richardson P.C.

(57) ABSTRACT

A laundry treating apparatus includes: a drum configured to receive laundry and to rotate about a rotation axis that extends in a front-rear direction of the laundry treating apparatus; and a lifter disposed on an inner circumferential surface of the drum and configured to rotate about the rotation axis based on rotation of the drum. The lifter includes: a lifter upper plate portion spaced apart from the inner circumferential surface of the drum, a lifter sidewall portion that is made of metal and that extends from lifter upper plate portion toward the inner circumferential surface of the drum, and a side protrusion that protrudes from an outer surface of the lifter sidewall portion. The lifter sidewall portion has a lower end coupled to the inner circumferential surface of the drum and an upper end connected to the lifter upper plate portion.

20 Claims, 15 Drawing Sheets

(51) Int. Cl.

| | |
|---|---|
| ***D06F 21/02*** | (2006.01) |
| ***D06F 37/04*** | (2006.01) |
| *D06F 21/10* | (2006.01) |

(56) References Cited

U.S. PATENT DOCUMENTS

| | | | | |
|---|---|---|---|---|
| 6,021,536 | A | 2/2000 | Wasinger et al. | |
| 6,167,733 | B1 | 1/2001 | Lee | |
| 9,062,405 | B2 | 6/2015 | Yoon et al. | |
| 2005/0097927 | A1 | 5/2005 | Kim et al. | |
| 2005/0204783 | A1 | 9/2005 | Kim et al. | |
| 2005/0252253 | A1* | 11/2005 | Ahn | D06F 37/06 68/142 |
| 2007/0017259 | A1 | 1/2007 | Cho et al. | |
| 2007/0295035 | A1 | 12/2007 | Lim | |
| 2009/0071202 | A1* | 3/2009 | Lee | D06F 37/06 68/212 |
| 2014/0318190 | A1* | 10/2014 | Kim | D06F 37/065 68/139 |
| 2014/0366283 | A1* | 12/2014 | Jun | H02K 15/02 8/137 |
| 2017/0067198 | A1* | 3/2017 | Kim | D06F 37/065 |
| 2017/0191202 | A1 | 6/2017 | Lee et al. | |
| 2019/0100865 | A1 | 4/2019 | Bauman et al. | |

FOREIGN PATENT DOCUMENTS

| | | |
|---|---|---|
| CN | 1616748 | 5/2005 |
| CN | 101089277 | 12/2007 |
| CN | 101668891 | 3/2010 |
| CN | 106939490 | 7/2017 |
| DE | 3803195 | 8/1989 |
| DE | 4041324 | 2/1996 |
| EP | 1306479 | 5/2003 |
| EP | 2251477 | 11/2010 |
| EP | 2385166 | 11/2011 |
| EP | 2732088 | 5/2014 |
| EP | 3162945 | 5/2017 |
| EP | 3190220 | 7/2017 |
| EP | 2426249 | 8/2017 |
| JP | 2003126595 | 5/2003 |
| JP | 2004057657 | 2/2004 |
| JP | 2010526637 | 8/2010 |
| JP | 2012055349 | 3/2012 |
| JP | 2019501000 | 1/2019 |
| KR | 20030034503 | 5/2003 |
| KR | 1020030060550 | 7/2003 |
| KR | 1020040022991 | 3/2004 |
| KR | 200358903 | 8/2004 |
| KR | 1020070048913 | 5/2007 |
| KR | 100765280 | 10/2007 |
| KR | 100802467 | 2/2008 |
| KR | 20100034923 | 4/2010 |
| KR | 20130032993 | 4/2013 |
| KR | 20130123543 | 11/2013 |
| KR | 101391735 | 5/2014 |
| KR | 101392423 | 5/2014 |
| KR | 20140084951 | 7/2014 |
| KR | 20140120549 | 10/2014 |
| KR | 20160068825 | 6/2016 |
| KR | 1020170082055 | 7/2017 |
| KR | 1020180072336 | 6/2018 |
| RU | 2520895 | 6/2014 |
| RU | 2604484 | 12/2016 |
| WO | WO2008140169 | 11/1998 |
| WO | WO2007000647 | 1/2007 |
| WO | WO2017119591 | 7/2017 |

OTHER PUBLICATIONS

JP Office Action in Japanese Appln. No. 2019-237649, dated Feb. 19, 2021, 12 pages (with English translation).
JP Office Action in Japanese Appln. No. 2019-237650, dated Feb. 22, 2021, 12 pages (with English translation).
Extended European Search Report in European Appln. No. 19219281.3, dated May 13, 2020, 7 pages.
Extended European Search Report in European Appln. No. 19219292.0, dated May 12, 2020, 8 pages.
Extended European Search Report in European Appln. No. 19219304.3, dated May 4, 2020, 6 pages.
Russian Office Action in Russian Appln. No. 2020104275 dated Jun. 16, 2020, 17 pages (with English translation).
Russian Notice of Allowance in Russian Appln. No. 2020104273, dated May 28, 2020, 23 pages (with English translation).
Russian Notice of Allowance in Russian Appln. No. 2020104274, dated Jun. 1, 2020, 23 pages (with English translation).
Australian Office Action in Australian Appln. No. 2020200653, dated Sep. 21, 2020, 7 pages.
Australian Office Action in Australian Appln. No. 2020200660, dated Sep. 21, 2020, 6 pages.
U.S. Office Action in U.S. Appl. No. 16/776,963, dated Mar. 29, 2021, 26 pages.
U.S. Office Action in U.S. Appl. No. 16/778,280, dated Apr. 8, 2021, 31 pages.
Office Action in Chinese Appln. No. 201911353149.7, dated Mar. 2, 2022, 22 pages (with English translation).
Office Action in Chinese Appln. No. 201911354126.8, dated Feb. 25, 2022, 17 pages (with English translation).
Office Action in Chinese Appln. No. 201911354136.1, dated Mar. 2, 2022, 16 pages (with English translation).

* cited by examiner

LAUNDRY TREATING APPARATUS

CROSS-REFERENCE TO RELATED APPLICATIONS

This application claims the benefit of priority to Korean Patent Application No. 10-2019-0013926, filed on Feb. 1, 2019, and Korean Patent Application No. 10-2019-0135459, filed on Oct. 29, 2019, the entire disclosures of which are incorporated herein by reference.

TECHNICAL FIELD

The present disclosure relates to a laundry treating apparatus having a rotary drum including lifters.

BACKGROUND

A washing machine may wash laundry with a rolling motion of the laundry. In some cases, a drum may include lifters configured to lift up laundry while rotating at a predetermined speed such that the laundry in the drum may be raised to a predetermined height and then roll down along an inner circumferential surface of the drum. The rolling motion may also gently rub the laundry by friction between the laundry and the drum while the laundry rolls.

In some cases, it may be difficult to implement the rolling motion of the laundry if the height of the lifter exceeds a certain level because the laundry may be excessively lifted up as the height of the lifter increases. That is, that is, a tumbling motion may occur. In this case, the laundry may be lifted up high due to drag force of the lifter, and thus a drop height of the laundry may also increase even when the drum is rotated at a low speed, and the laundry may fall directly onto a bottom portion of the drum instead of rolling.

In some cases, where the height of the lifter is low, laundry falling down while rolling, in which the laundry has not yet reached a lowest point of the drum, may climb over the lifter during the rolling motion even if the drum is rotated at a higher speed, and as a result, the laundry may roll for a longer time.

To lift up, by the lifter, laundry which has fallen down to the approximately lowest point of the drum, it may be necessary to consider a structure that can generate friction between the lifter and the laundry greater than a certain level.

In some cases, a washing machine may include a plurality of lifters on an inner circumferential surface of a drum that rotates about an approximately horizontal rotation axis.

The lifter may include a first member coupled to an inner circumferential surface of the drum, and a second member that is mounted on the first member and protrudes to the inside of the drum so as to lift up laundry when the drum is rotated.

The second member may be formed approximately in the shape of a dome so as to define a space in which the laundry is accommodated. The first member may include a first portion mounted on the inner circumferential surface of the drum and a second portion convexly protruding from the mounting portion and inserted into the space.

A base of the dome shape of the second member may be in contact with the second portion, but a vertex of the dome shape spaced apart from the base in a radial direction may be spaced apart from the second portion.

Since the vertex of the dome shape cannot be supported by the first member, an internal space of the second member, particularly the vertex of the dome shape, may be depressed when the second member is pressed by an external force.

In some cases, where the second member is made of metal, for example, stainless steel, due to plastic deformation of the materials, the second member may not be restored to its original shape.

In some cases, where the second member may not be restored to its original shape due to plastic deformation, the balance between the lifters may be broken. Accordingly, eccentricity may occur during rotation of the drum, and an imbalance may occur due to the load applied to the drum by the lifters. In a severe case, the drum may be deformed or damaged.

In some cases, where a gap between an outer surface of the first member and an inner surface of the second member becomes small due to the deformation of the second member, foreign substances may be trapped in the gap, which may cause hygienic problems.

A cylindrical drum may include mounting holes for mounting lifters. The mounting holes may be defined in a quadrangular metal plate, which then be rolled to form the cylindrical drum.

In some examples, a lifter may be installed in a drum by using mounting holes. For example, the mounting holes may be arranged in a front-rear direction of the drum at predetermined intervals, and a set of mounting holes arranged in this manner may be used to mount one lifter. In some cases, the lifter may include hooks corresponding to the number of the set of mounting holes, and the hooks may be caught by the mounting holes, respectively.

In some examples, a pair of lifters (or baffles), which constitutes a set, may be disposed, in a row in a front-rear direction, on an inner circumferential surface of a drum, and the lifters may be disposed at predetermined intervals along a circumferential direction of the drum.

In some cases, a manufacturer may design drums with different capacities depending on product specifications. For instance, the manufacturer may selectively manufacture a drum (e.g., a large-capacity drum) elongated in the front-rear direction and a relatively short drum (e.g., a small-capacity drum) by cutting, based on a design dimension, a metal plate to a length of a side of the metal plate corresponding to a length in the front-rear direction of the drum to be manufactured.

In some cases, the distance between the pair of lifters may need to be changed in accordance with the length in the front-rear direction of the drum. In some examples, where the hooks formed on the lifters are fastened only to the designated mounting holes, the interval between the pair of lifters may be inevitably constant even when the length of the drum varies. In such examples, where the interval between the lifter positioned at a front side and the lifter positioned at a rear side is inevitably constant regardless of the length of the drum as described above, the laundry positioned at a front or rear end of the drum may not come into contact with the lifters due to the distance between a front end of the lifter positioned at the front side and a front end of the drum or between the lifter positioned at the rear side and a rear end of the drum increasing as the length of the drum increases.

In some examples, a washing machine may include a hook that protrude from one surface of the lifter, and a hook through-hole is defined in the drum such that the hook is caught by the hook through-hole.

The hook may include a neck extending from a lifter main body, and a head expanding from an end of the neck so as to have a larger width than the neck. The lifter may be installed such that the head is caught by an outer surface of the drum in a state in which the neck is positioned in the hook through-hole.

The lifter having the hook as described above may be made by injection molding with a mold including an upper mold configured to form an upper surface of the lifter main body, and a lower mold configured to form a lower surface of the lifter main body. In some cases, undercutting may occur due to a part of the head vertically overlapping the lifter main body.

In some examples, a lifter housing may be installed on an inner circumferential surface of a drum, and a groove structure may extend in a longitudinal direction of the lifter housing. The groove structure may improve structural rigidity of the lifter housing by a bent cross-sectional structure.

In some cases, where a surface of the groove structure is recessed inward, there may be a limitation in increasing a contact area with laundry. In some cases, a complicated and difficult groove forming process may need to be performed in order to form the groove structure with the material of the lifter housing.

SUMMARY

The present disclosure describes a laundry treating apparatus in which frictional action between lifters and laundry (fabrics) smoothly occurs.

The present disclosure describes a laundry treating apparatus capable of improving an operation of rubbing laundry by using friction between lifters and laundry even when a height of the lifter is decreased.

The present disclosure describes a laundry treating apparatus capable of maintaining friction between lifters and laundry at a predetermined level or higher, thereby smoothly performing an operation of lifting up laundry by using the lifters.

The present disclosure describes a laundry treating apparatus in which rigidity of a lifter is increased, such that the lifter is not easily deformed.

The present disclosure describes a laundry treating apparatus in which sufficient rigidity of a lifter is ensured even when a frame cover, which defines an external shape of the lifter, is formed by a thin metal plate.

According to one aspect of the subject matter described in this application, a laundry treating apparatus includes: a drum configured to receive laundry and to rotate about a rotation axis that extends in a front-rear direction of the laundry treating apparatus; and a lifter disposed on an inner circumferential surface of the drum and configured to rotate about the rotation axis based on rotation of the drum. The lifter includes: a lifter upper plate portion spaced apart from the inner circumferential surface of the drum, a lifter sidewall portion that is made of metal and that extends from lifter upper plate portion toward the inner circumferential surface of the drum, and a side protrusion that protrudes from an outer surface of the lifter sidewall portion. The lifter sidewall portion has a lower end coupled to the inner circumferential surface of the drum and an upper end connected to the lifter upper plate portion.

Implementations according to this aspect may include one or more of the following features. For example, the side protrusion may extend along a circumference of the outer surface of the lifter sidewall portion. The side protrusion may surround at least a portion of the circumference of the outer surface of the lifter sidewall portion.

In some implementations, the side protrusion may include a plurality of side protrusions that respectively extend along circumferences of the lifter sidewall portion and that are spaced apart from each other. In some examples, the plurality of side protrusions may extend in parallel to one another on the lifter sidewall portion. In some examples, the plurality of side protrusions may include: a first side protrusion that has a first ring shape; and a second side protrusion that has a second ring shape and that extends in parallel to the first side protrusion.

In some examples, the second side protrusion may be disposed between the lifter upper plate portion and the first side protrusion, and a circumferential length of the second side protrusion may be greater than a circumferential length of the first side protrusion.

In some implementations, the lifter may include: a lifter frame installed on the inner circumferential surface of the drum; and a frame cover that is coupled to the lifter frame, that protrudes radially inward from the inner circumferential surface of the drum, and that includes the lifter sidewall portion and the lifter upper plate portion. In some examples, the lifter frame may be made of synthetic resin, and the frame cover may be made of stainless steel. In some examples, the side protrusion may protrude from an outer surface of the frame cover and corresponds to a concave recessed from an inner surface of the frame cover.

In some examples, the frame cover may include: a cover upper plate that defines the lifter upper plate portion; and a cover sidewall that defines the lifter sidewall portion. The cover sidewall may include a coupling tab that protrudes from a lower end of the cover sidewall, and the lifter frame may define a tab binding port configured to receive the coupling tab based on the lifter frame being coupled to the frame cover.

In some implementations, the lifter frame may include: a frame base that is coupled to the inner circumferential surface of the drum and that defines a seating groove configured to receive a lower end of the frame cover based on the lifter frame being coupled to the frame cover; a frame upper plate spaced apart from the frame base in a direction toward an inside of the drum; and a frame sidewall that connects the frame upper plate to the frame base. The tab binding port may be defined in the seating groove.

In some implementations, the lifter may include: a plurality of front lifters disposed at a front portion of the drum and arranged along a circumferential direction of the drum; and a plurality of rear lifters disposed at rear sides of the plurality of front lifters and arranged along the circumferential direction of the drum.

According to another aspect, a laundry treating apparatus includes: a tub configured to receive washing water; a drum disposed in the tub and configured to receive laundry, the drum being configured to rotate about a rotation axis that extends in a front-rear direction of the laundry treating apparatus; and a lifter disposed on an inner circumferential surface of the drum and configured to rotate about the rotation axis based on rotation of the drum. The lifter includes: a lifter frame installed on the inner circumferential surface of the drum and made of synthetic resin, and a frame cover that is coupled to the lifter frame, that protrudes radially inward from the inner circumferential surface of the drum, and that is made of metal. The frame cover includes: a cover upper plate spaced apart from the inner circumferential surface of the drum; a cover sidewall that extends from the cover upper plate to the inner circumferential surface of the drum and that has a lower end coupled to the inner circumferential surface of the drum and an upper end connected to the cover upper plate; and a side protrusion that protrudes from an outer surface of the cover sidewall.

Implementations according to this aspect may include one or more of the following features. For example, the side protrusion may define a closed curve that extends along a circumference of the outer surface of the cover sidewall. In some examples, the side protrusion may include a plurality of side protrusions that respectively extend along circumferences of the cover sidewall and that are spaced apart from each other. In some examples, the plurality of washing protrusions may extend in parallel to one another on the cover sidewall.

In some implementations, the plurality of side protrusions may include: a first side protrusion that has a first ring shape; and a second side protrusion that has a second ring shape and that extends in parallel to the first side protrusion. In some examples, the second side protrusion may be disposed between the cover upper plate and the first side protrusion, and a circumferential length of the second side protrusion may be greater than a circumferential length of the first side protrusion.

In some implementations, the frame cover may further include an upper plate protrusion that protrudes from the cover upper plate toward an inside of the drum. In some examples, the upper plate protrusion protrudes from an outer surface of the cover upper plate, and the frame cover may define a recess at an inner surface of the cover upper plate facing the lifter frame. The recess may be defined at a position corresponding to the upper plate protrusion.

According to another aspect, a lifter is configured to be disposed on an inner circumferential surface of a drum of a laundry treating apparatus and configured to, based on rotation of the drum, rotate about a rotation axis that extends in a front-rear direction of the laundry treating apparatus. The lifter includes: a lifter upper plate portion spaced apart from the inner circumferential surface of the drum; a lifter sidewall portion that is made of metal, that extends from lifter upper plate portion toward the inner circumferential surface of the drum, and that has a lower end coupled to the inner circumferential surface of the drum and an upper end connected to the lifter upper plate portion; and a side protrusion that protrudes from an outer surface of the lifter sidewall portion.

Implementations according to this aspect may include one or more of the features of the lifter described above.

In some implementations, the effect of rubbing laundry is improved by the frictional action between the laundry and a washing protrusion formed on the lifter.

In some implementations, it may be possible to lift up the laundry to a predetermined level or higher by using the frictional action between the washing protrusion and the laundry even when the height of the lifter is decreased in comparison with the related art.

In some implementations, the flow of the fabrics may be improved, and fabric distribution may be smoothly performed by the frictional action between the washing protrusion and the laundry.

In some implementations, the frame cover, which defines an exterior of the lifter, may be formed by a thin plate made of metal (for example, stainless steel) and provide sufficient rigidity with the washing protrusion to avoid deformation of the frame cover.

BRIEF DESCRIPTION OF THE DRAWINGS

The above and other aspects, features, and advantages of the present disclosure will become apparent from the detailed description of the following aspects in conjunction with the accompanying drawings.

FIG. 20A illustrates an example of a small-capacity drum, and FIG. 20B illustrates an example of a large-capacity drum.

DETAILED DESCRIPTION

Advantages and features of the present disclosure and methods for achieving them will become apparent from the exemplary implementations described below with reference to the accompanying drawings. However, the present disclosure is not limited to the exemplary implementations disclosed herein but may be implemented in various different forms. The exemplary implementations are provided to make the description of the present disclosure thorough and to fully convey the scope of the present disclosure to those skilled in the art. It is to be noted that the scope of the present disclosure is defined only by the claims.

Hereinafter, a washing machine will be described as an example of a laundry treating apparatus, but the laundry treating apparatus is not limited to the washing machine. The laundry treating apparatus is an apparatus for treating laundry (or an object to be dried) such as clothes inputted into a drum 51 and may be a dryer or a washing-drying machine.

Figure 1:
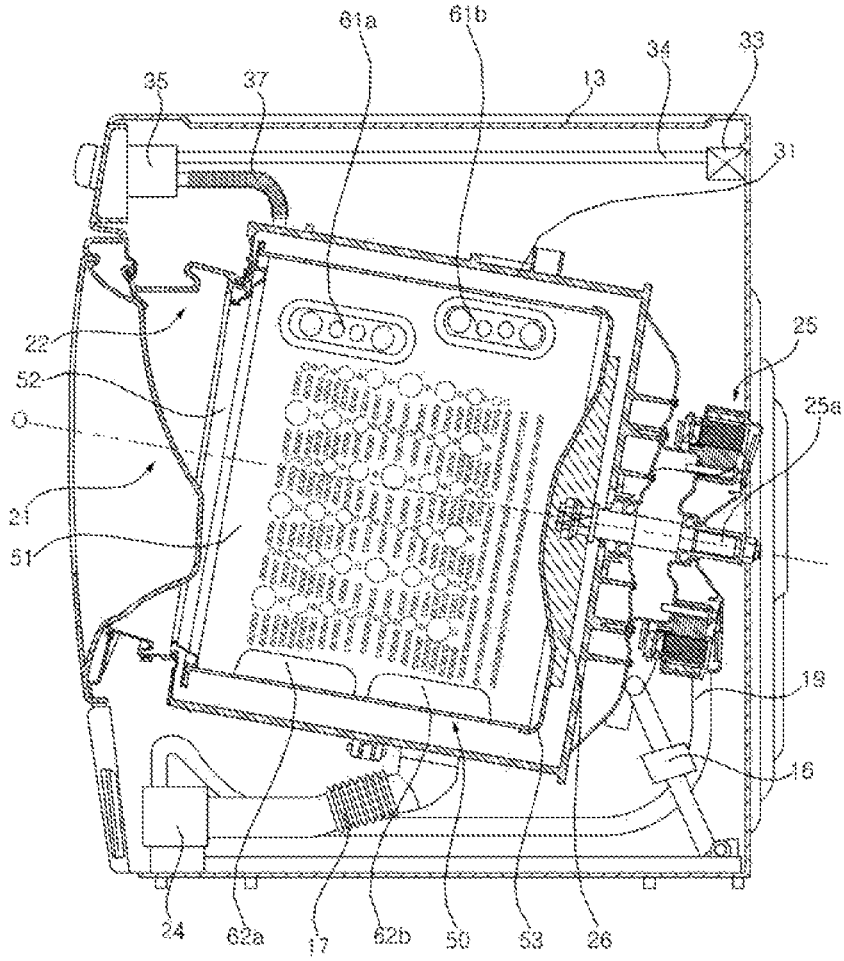
FIG. 1 is a cross-sectional view showing an example of a laundry treating apparatus.

Referring to FIG. 1, a laundry treating apparatus may include a casing 13 configured to define an exterior, a water storage tub 31 disposed in the casing 13 and configured to store washing water, a washing tub 50 rotatably installed in the water storage tub 31 and configured to receive inserted laundry, and a motor 25 configured to rotate the washing tub 50. A damper 16 configured to absorb vibration of the water storage tub 31 may be provided in the casing 13.

A drum 51 may be rotated about a rotation axis O extending in a front-rear direction, and the drum 51 may constitute the washing tub 50. The rotation axis is approximately horizontal. However, the term "horizontal" does not mean "geometrically horizontal" in a strict sense. In a case in which an inclination is closer to a horizontal axis than a vertical axis even though the inclination is formed at a certain angle with respect to the horizontal axis as illustrated in FIG. 1, it will be said that the drum 51 or the washing tub 50 is rotated about the horizontal axis.

A laundry insertion port is formed in a front surface of the casing 13, and a door 21 configured to open or close the laundry insertion port may be rotatably provided on the casing 13. A tubular gasket 22 is provided such that the laundry insertion port and an inlet of the water storage tub 31 communicate with each other. The gasket 22 is made of a soft material (for example, rubber). A front end of the gasket 22 may be connected to a circumference of the laundry insertion port of the casing 13, and a rear end of the gasket 22 may be connected to a circumference of the inlet of the water storage tub 31.

A water supply valve 33, a water supply pipe 34, and a water supply hose 37 may be installed in the casing 13. When the water supply valve 33 is opened and the washing water is supplied, the washing water that has passed through the water supply pipe 34 may be mixed with detergent in a dispenser 35 that stores the detergent, and then the washing water may be supplied to the water storage tub 31 through the water supply hose 37.

An input port of a pump 24 is connected to the water storage tub 31 through the drain hose 17, and a discharge port of the pump 24 is connected to drain pipes 19. The water discharged from the water storage tub 31 through the drain hose 17 is pumped by the pump 24, flows through the drain pipes 19, and then is discharged to the outside of the laundry treating apparatus.

The washing tub 50 may include the drum 51, a front cover 52 coupled to a front end of the drum 51, and a rear cover 53 coupled to a rear end of the drum 51. The drum 51 may be formed in the form of a tubular (or cylindrical) body made by rolling up a metal plate (for example, made of stainless steel) having a plurality of through-holes 51*h* (see FIGS. 5A and 5B) and then joining both ends of the metal plate. The water stored in the water storage tub 31 may be introduced into the washing tub 50 through the through-holes 51*h*. A plurality of embossed portions 51*a* (see FIGS. 5A and 5B), which are convexly formed by plastic processing, may be formed on an inner circumferential surface of the drum 51, and the through-holes 51*h* may be formed between the embossed portions 51*a*.

An opening portion may be formed in the front cover 52 so that laundry may be inserted into the drum 51. The inlet of the water storage tub 31 communicates with the opening portion. The front cover 52 may be made of the same type of material as the drum 51.

The rear cover 53 closes an opened rear side of the drum 51, and a spider 26 connected to a driving shaft 25*a* of the motor 25 may be coupled to a rear surface of the rear cover 53. The spider 26 is configured to transmit rotational force of the driving shaft 25*a* to the washing tub 50, and the driving shaft 25*a* of the motor 25 may be coupled to a center of the spider 26.

A plurality of lifters 61*a*, 61*b*, 62*a*, 62*b*, 63*a*, and 63*b* are provided in the drum 51. When the drum 51 is rotated, the laundry is lifted up by the lifters 61*a*, 61*b*, 62*a*, 62*b*, 63*a*, and 63*b*.

The plurality of lifters 61*a*, 61*b*, 62*a*, 62*b*, 63*a*, and 63*b* include first and second lifters disposed in the front-rear direction of the drum 51. Hereinafter, an example in which the first lifters are front lifters 61*a*, 62*a*, and 63*a* and the second lifters are rear lifters 61*b*, 62*b*, and 63*b* spaced apart from the front lifters in the rearward direction will be described. However, the first lifter may be the rear lifter and the second lifter may be the front lifter depending on the implementation.

Figure 18A:
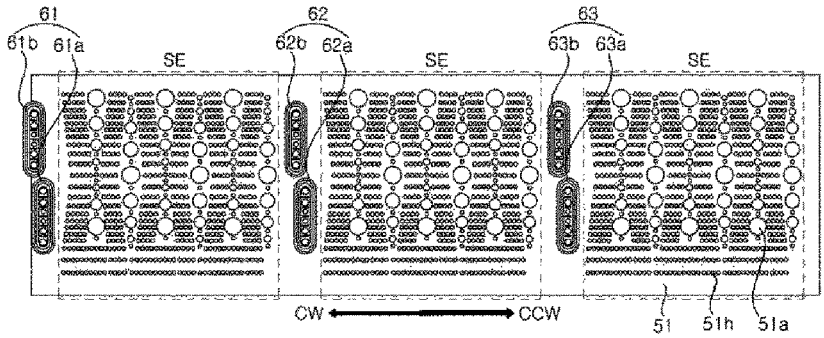
FIG. 18A is a view illustrating an example in which the drum illustrated in FIG. 1 is deployed.
Figure 18B:
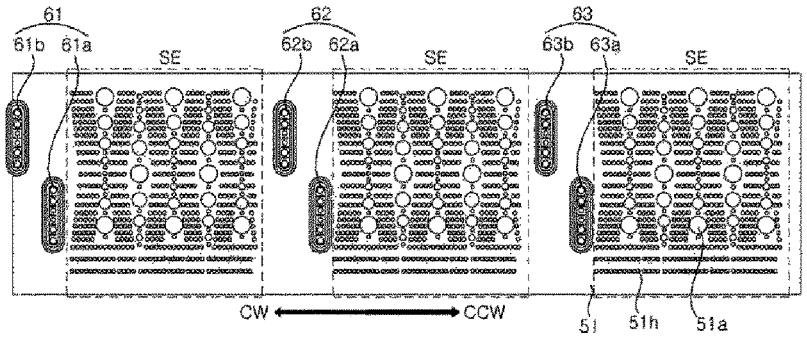
FIG. 18B is a view illustrating an example of a developed view of the drum having the lifters.

Referring to FIGS. 1, 18A, and 18B, the plurality of front lifters 61*a*, 62*a*, and 63*a*, together with the plurality of rear lifters 61*b*, 62*b*, and 63*b*, define sets (or pairs), respectively. Three sets of lifters 61 (61*a* and 61*b*), 62 (62*a* and 62*b*), and 63 (63*a* and 63*b*) may be disposed at equal angles about the rotation axis O, but the present disclosure is not necessarily limited thereto. For example, four sets of lifters may be disposed at an interval of 90 degrees or five sets of lifters may be disposed at an interval of 72 degrees about the rotation axis O.

Hereinafter, an example in which the front lifters 61*a*, 62*a*, and 63*a* and the rear lifters 61*b*, 62*b*, and 63*b* have the same structure will be described, but the present disclosure is not necessarily limited thereto.

Figure 2:
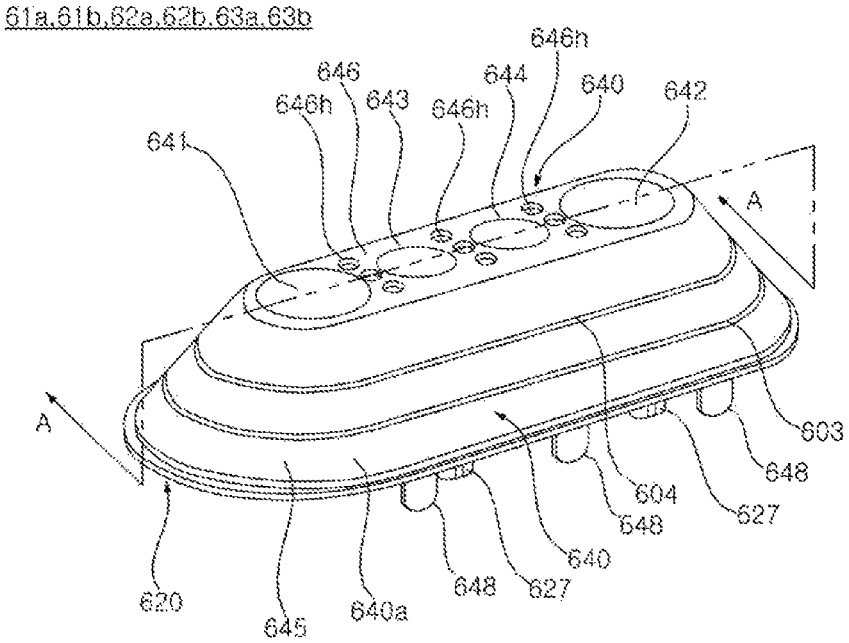
FIG. 2 is a perspective view showing an example of a lifter illustrated in FIG. 1.
Figure 3:
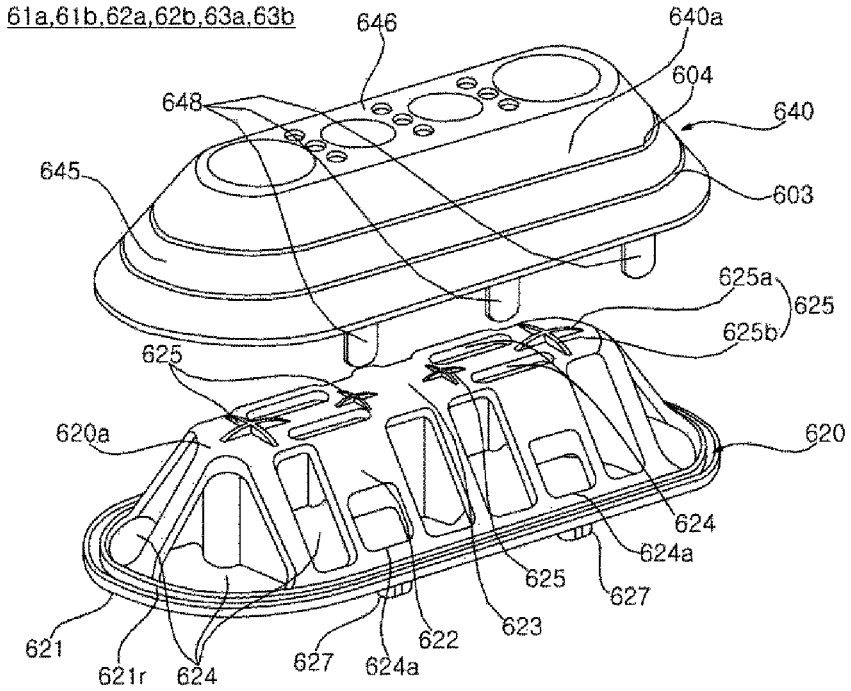
FIG. 3 is an exploded perspective view showing the lifter illustrated in FIG. 2.
Figure 4:
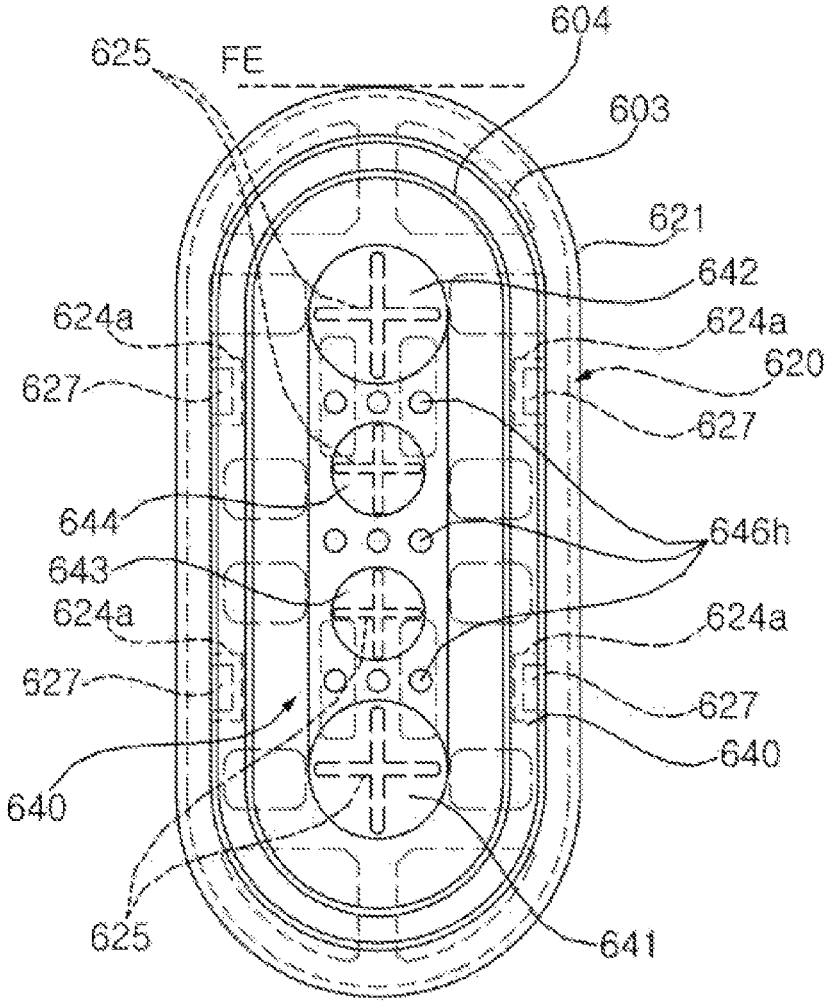
FIG. 4 is a plan projection view showing the lifter illustrated in FIG. 2.

Referring to FIGS. 2 to 4, each of the lifters 61*a*, 61*b*, 62*a*, 62*b*, 63*a*, and 63*b* includes a lifter frame 620 fixed to the drum 51, and a frame cover 640 configured to cover the lifter frame 620. The frame cover 640 protrudes radially inward (toward the inside of the drum 51) from the inner circumferential surface of the drum 51 and comes into contact with the laundry. The frame cover 640 is fixed to the drum 51 by the lifter frame 620 instead of being fixed directly to the drum 51.

The lifter frame 620 may be made of synthetic resin. The lifter frame 620 may be formed by injection molding, but the present disclosure is not limited thereto.

A lifter made of metal is not only excellent in strength, but also luxurious and hygienic. In order to couple the lifter directly to a drum made of metal, it is necessary to weld the lifter to a raw material cut out in a shape of the deployed drum, roll up the raw material in a cylindrical shape, and then weld together the ends of the raw material where they meet each other. However, raw material that was flat becomes curved during the process of rolling up the raw material, and as a result, there is a concern that stress may be applied to the welded portions between the lifter and the drum and cause the welded portions to separate.

In order to address this concern, the present disclosure proposes a configuration in which a frame cover 640 made of metal is fixed to the drum 51 by a lifter frame 620 made of synthetic resin.

In some examples, referring to FIG. 3 and FIGS. 8 to 12, the whole of an outer surface 620*a* (see FIG. 8) of the lifter frame 620 has a convex shape, and an inner surface 620*b* (see FIG. 9) of the lifter frame 620 has a concave shape. Specifically, the lifter frame 620 may include a frame base 621, a frame upper plate 623, and a frame sidewall 622.

The frame base 621 is fixed to the inner circumferential surface of the drum 51. The frame base 621 may have a ring shape (or a closed shape formed by a single line) opened at a central portion thereof. For example, the frame base 621 may define an opening at the center portion, and the opening may be surrounded by a periphery or boundary of the frame base 621.

The frame upper plate 623 is spaced apart from the frame base 621 in the direction toward the inside of the drum 51 and connected to the frame base 621 by the frame sidewall 622. The frame sidewall 622 may be formed in the form of a tubular (or cylindrical) body, such that a lower end of the frame sidewall 622 is connected to the frame base 621, and an upper end of the frame sidewall 622 is connected to the frame upper plate 623.

The frame sidewall 622 is shaped such that a contour of a cross section thereof gradually decreases upward from the lower end connected to the frame base 621 (or in the radial direction of the drum 51) (or gradually decreases in a direction away from the inner circumferential surface of the drum 51), and the contour of the cross section is smallest at a portion that meets the frame upper plate 623.

One or more water flow inlet holes may be formed in the drum 51 so as to allow the washing water stored in the water storage tub 31 to be introduced to the inside of the frame cover 640. Any opening portion formed in a region covered by the frame cover 640 may be a water flow inlet hole. For example, some of the through-holes 51*h*, which are positioned inside the frame cover 640, may be water flow inlet holes. Furthermore, mounting slots 511*a* and 511*b*, fastening holes 513*a* and 513*b*, and opening portions 512*a* and 512*b*, which will be described below, may be water flow inlet holes.

Referring to FIG. 3, one or more water flow through-holes 624 and 624*a* may be formed in the lifter frame 620. Any opening may be a water flow through-hole 624 as long as the opening is formed in the lifter frame 620 and allows the inside and the outside of the lifter frame 620 to communicate with each other.

The water flow through-hole 624 may be formed in the frame sidewall 622 and/or the frame upper plate 623. The washing water stored in the concave space of the lifter frame 620 may be discharged through the water flow through-hole 624.

One or more water flow discharge holes 646*h* may be formed in the frame cover 640 to discharge the washing water in the lifters 61*a*, 61*b*, 62*a*, 62*b*, 63*a*, and 63*b* into the drum 51. The washing water in the concave space inside the lifter frame 620 may pass through the water flow through-hole 624, and then may be discharged into the drum 51 through the water flow discharge hole 646*h*.

An outer surface 640*a* of the frame cover 640, which is exposed to the inside of the drum 51 and comes into contact with the laundry, has a convex shape, and an inner surface of the frame cover 640 has a concave shape that corresponds to the convex outer surface 620*a* of the lifter frame 620. The frame cover 640 may be made of metal, for example, stainless steel, but the present disclosure is not limited thereto. The frame cover 640 may be formed by plastically processing (for example, pressing) a metal plate having a predetermined thickness.

The frame cover 640 may include a cover sidewall 645 extending upward from a lower end adjoining the frame base 621, and a cover upper plate 646 configured to cover an upper side of the cover sidewall 645. The cover upper plate 646 is approximately parallel to the frame upper plate 623. In some examples, the plurality of water flow discharge holes 646*h* may be formed in the cover upper plate 646.

In some examples, the water flow discharge holes 646*h* may be defined in an upper surface (e.g., the cover upper plate 646) of the frame cover 640, and may not be defined in the lateral side surface (e.g., outer surface 640*a*) of the frame cover 640.

The cover sidewall 645 may be shaped such that a contour of a cross section thereof gradually decreases upward from the lower end (or in the radial direction of the drum 51) (or gradually decreases in the direction away from the inner circumferential surface of the drum 51), and the contour of the cross section is smallest at a portion that meets the cover upper plate 646.

In some implementations, the lifter frame 620 may include spacers 625 that protrude from the frame upper plate 623 so as to allow the frame cover 640 to be spaced apart from the lifter frame 620. The spacer 625 protrudes from the frame upper plate 623 to the inner surface of the frame cover 640.

The inner surface of the frame cover 640 may be spaced apart from the frame upper plate 623 to a degree equal to or greater than a length (or height) of the spacer 625 protruding from the frame upper plate 623. The spacer 625 may be spaced apart from the inner surface of the frame cover 640 at a predetermined distance. In this case, the inner surface of the frame cover 640 is spaced apart from the frame upper plate 623 at a distance equal to a sum of the height of the spacer 625 and the interval between the spacer 625 and the inner surface of the frame cover 640. When the frame cover 640 is pressed by external force, the frame cover 640 comes into contact with the frame upper plate 623, such that the frame cover 640 is prevented from being deformed any further.

In some examples, one or both of the frame cover 640 and the lifter frame 620 may expand in hot water. In examples where the lifter frame 620 is made of synthetic resin and the frame cover 640 is made of metal, the thermal expansions of the frame cover 640 and the lifter frame 620 may be different from each other. The spacer 625 may secure a space between the frame cover 640 and the lifter frame 620 when they are thermally expanded.

Alternatively, the spacer 625 may be configured to come into contact with the frame cover 640, depending on the embodiment. In this case, the spacer 625 protrudes from the outer surface 620*a* of the lifter frame 620 and adjoins the inner surface of the frame cover 640. Because the spacer 625 supports the inner surface of the frame cover 640 in the state in which the frame upper plate 623 is spaced apart from the frame cover 640, the state in which the frame cover 640 is spaced apart from the frame upper plate 623 may be maintained even though the frame cover 640 is pressed toward the lifter frame 620 by external force.

The spacer 625 may have a cross-shaped rib structure. Specifically, the spacer 625 may include a vertical rib 625*a* extending on the frame upper plate 623 in a longitudinal direction of the lifter frame 620 (or the front-rear direction), and a horizontal rib 625*b* extending while crossing (that is intersecting) the vertical rib 625*a*. The vertical rib 625*a* and the horizontal rib 625*b* may be orthogonal to each other.

A portion of the spacer 625, where the vertical rib 625*a* and the horizontal rib 625*b* intersect each other, may be maximally spaced apart from the frame upper plate 623. In some implementations, the intersecting portion may be spaced apart from the inner surface of the frame cover 640 in the case of the contactless type spacer 625. In some implementations, the intersecting portion may be in contact with the inner surface of the frame cover 640 in the case of the contact type spacer 625.

Figure 10:
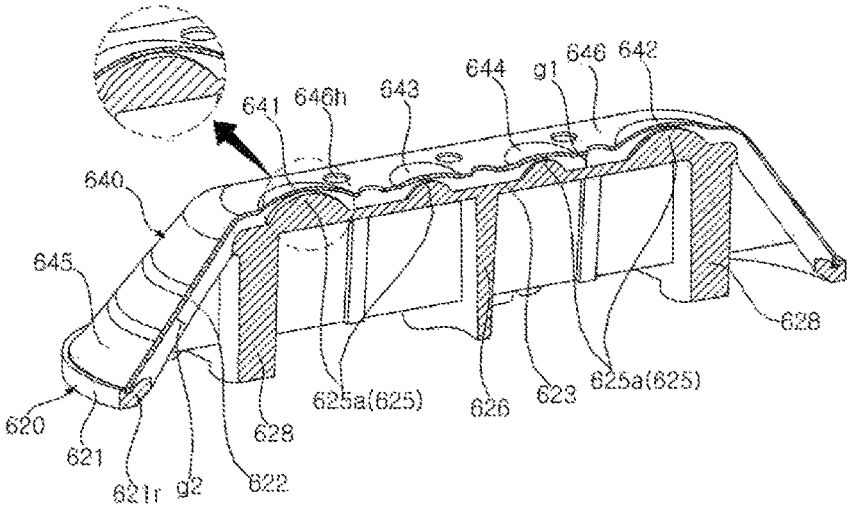
FIG. 10 is a cross-sectional view taken along a line A-A illustrated in FIG. 2.

Referring to FIG. 10, the inner surface of the cover upper plate 646 may be spaced apart from the outer surface of the frame upper plate 623. That is, a predetermined separation space (or a gap g1) may be formed between the inner surface of the cover upper plate 646 and the outer surface of the frame upper plate 623, and the separation space g1 may serve as a flow path that guides the washing water to the water flow discharge hole 646*h*.

A separation space g2 may also be formed between the frame sidewall 622 and the cover sidewall 645. A seating groove 621*r* (see FIGS. 8 and 9) to be described below is formed in the frame base 621 and disposed at a position toward the outside of the frame base 621 spaced apart from the frame sidewall 622 at a predetermined distance. Therefore, the lower end of the cover sidewall 645 positioned in the seating groove 621*r* is spaced apart from the frame sidewall 622. Because the lower end of the frame cover 640 is spaced apart from the frame sidewall 622 by the seating groove 621*r* and the cover upper plate 646 is spaced apart from the frame upper plate 623 by the spacer 625, two points of the frame cover 640, which are the lower end of the frame cover 640 and the portion of the frame cover 640 supported by the spacer 625, are forcibly spaced apart from the lifter frame 620, and as a result, the state in which the cover sidewall 645 positioned between the two points is spaced apart from the lifter frame 620 is maintained.

The washing water introduced into each of the lifters 61*a*, 61*b*, 62*a*, 62*b*, 63*a*, and 63*b* is introduced into the separation spaces g1 and g2, and water flows formed in the separation spaces g1 and g2 during the rotation of the washing tub 50 clean the outer surface of the lifter frame 620 and the inner surface of the frame cover 640. Foreign substances produced during the cleaning process may be discharged through the water flow discharge hole 646*h* formed in the frame cover 640 or through the water flow inlet hole formed in the drum 51. The flow paths are formed between the lifter frame 620 and the frame cover 640 by the separation spaces g1 and g2, and as a result, this configuration may be advantageous in maintaining the lifters 61*a*, 62*a*, 63*a*, 61*b*, 62*b*, and 63*b* in a clean state.

The frame cover 640 may have upper plate protrusions such as domes 641, 642, 643, and 644 defined at the positions corresponding to the spacers 625. For example, the spacers 625 may be disposed below the domes 641, 642, 643, and 644, respectively. In this regard, the domes 641, 642, 643, and 644 may be referred to as the upper plate protrusions for convenience of description. The present disclosure is not necessarily limited thereto, and the upper plate protrusion may have various structures protruding upward from the cover upper plate.

In the case in which the plurality of spacers 625 are formed in the exemplary implementation, the plurality of domes 641, 642, 643, and 644 may be formed at the positions corresponding to the plurality of spacers 625, respectively.

The domes 641, 642, 643, and 644 may be formed on the cover upper plate 646. An inner surface of each of the domes 641, 642, 643, and 644, which faces the spacer 625, may be concavely formed, and an outer surface of each of the domes 641, 642, 643, and 644 may be convexly formed. The concave inner surface of each of the domes 641, 642, 643, and 644 may be spaced apart from the spacer 625. However, the present disclosure is not limited thereto, the spacer 625 may be in contact with the concave inner surface.

The domes 641, 642, 643, and 644 are convexly formed by pressing the cover upper plate 646, which is made of metal. The plurality of domes 641, 642, 643, and 644 may be disposed in the longitudinal direction of the cover upper plate 646 (or the longitudinal direction of the lifters 61*a*, 61*b*, 62*a*, 62*b*, 63*a*, and 63*b*). The one or more water flow discharge holes 646*h* may be formed between the adjacent domes 641, 642, 643, and 644.

Assuming that the cover upper plate 646 has a plurality of regions spaced apart from one another in the longitudinal direction, the water flow discharge holes 646*h* may be formed in the respective regions. In the exemplary implementation, the water flow discharge holes 646*h* are formed in three regions, and the three (that is, a plurality of) water flow discharge holes 646*h* are arranged in each of the regions in a width direction of the cover upper plate 646.

The spacers 625 may be positioned between the plurality of regions. That is, the spacers 625 may be positioned between the adjacent two regions among the plurality of regions when the cover upper plate 646 is viewed from above.

The domes 641, 642, 643, and 644 may include two or more domes of which the depth of the concave portion of the inner surfaces thereof is different from each other. In more detail, the domes 641, 642, 643, and 644 may include large domes 641 and 642, each of which have a concave portion of a first depth, and small domes 643 and 644, each of which have a concave portion of a second depth smaller than the first depth. The height of the spacers corresponding to the large domes 641 and 642 may be greater than the height of the spacers corresponding to the small domes 643 and 644.

The domes 641, 642, 643, and 644 may include the two or more domes having different sizes. Each of the domes 641, 642, 643, and 644 may have a circular shape, but the present disclosure is not necessarily limited thereto. Here, the 'size' may be determined based on the shape when the concave portion of the inner surface of each of the domes 641, 642, 643, and 644 are viewed from above, and for example, the 'size' may be defined as a diameter of the concave portion. However, since the difference between the inner diameter and the outer diameter of each of the domes 641, 642, 643, and 644 is merely due to the thickness of the material, the size may be defined based on the outer diameter of each of the domes 641, 642, 643, and 644.

Figure 13:
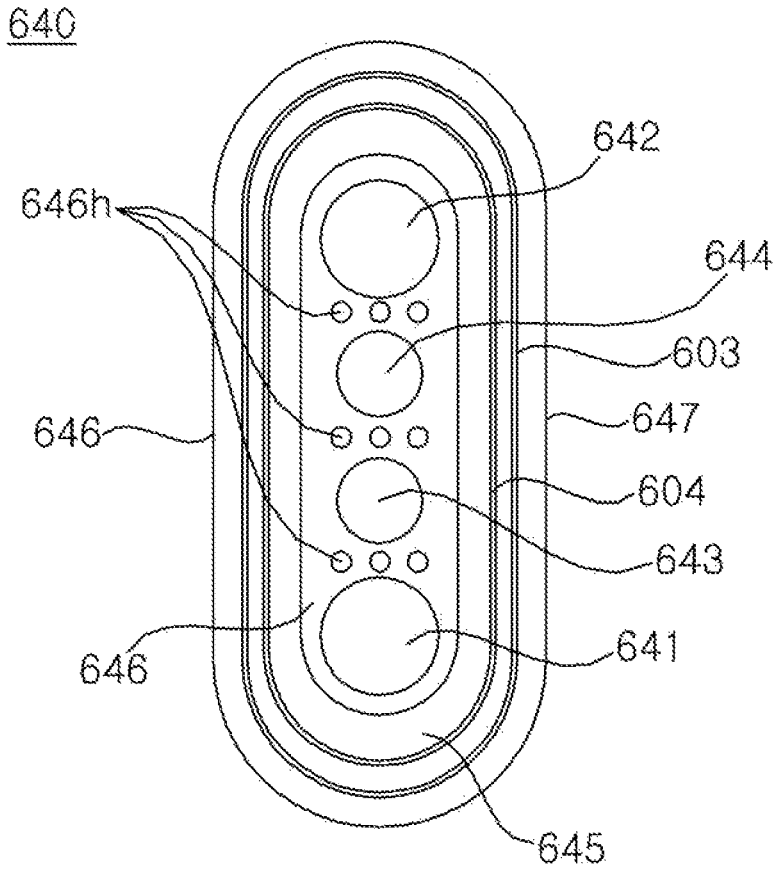
FIG. 13 is a top plan view showing an example of a frame cover.

The size of the spacer 625 may also vary depending on the size of each of the domes 641, 642, 643, and 644. That is, in the case in which there are the large domes 641 and 642 and the small domes 643 and 644 as illustrated in FIG. 13, the spacer 625 corresponding to the large domes 641 and 642 may be larger than the spacer 625 corresponding to the small domes 643 and 644.

The two small domes 643 and 644 may be positioned between the pair of large domes 641 and 642, and the water flow discharge holes 646*h* may be formed between the domes 641, 642, 643, and 644. The plurality of water flow discharge holes 646*h* may be arranged in a direction crossing the lifters 61*a*, 61*b*, 62*a*, 62*b*, 63*a*, and 63*b* (or a direction orthogonal to the length of each of the lifters 61*a*, 61*b*, 62*a*, 62*b*, 63*a*, and 63*b*).

Since the domes 641, 642, 643, and 644 protrude from the cover upper plate 646, the gaps between the laundry and the surfaces at the periphery of the water flow discharge holes 646*h* may be maintained even when laundry is placed on the domes 641, 642, 643, and 644. Therefore, the water flow discharge holes 646*h* may be prevented from being clogged with laundry, and the water discharged into the gaps from the water flow discharge holes 646*h* may be applied to the laundry.

In some implementations, the plurality of upper plate protrusions such as domes 641, 642, 643, and 644 may be configured to, based on the laundry covering a space defined between the adjacent upper plate protrusions, separate the laundry from a portion of the cover upper plate 646 to thereby allow discharge the washing water through the one or more water flow discharge holes 646*h*.

In some implementations, a distance between the adjacent upper plate protrusions may be less than a width of each of the adjacent upper plate protrusions to facilitate the discharge of washing water. For example, a distance between edges of the domes 641 and 643 facing each other may be less than a diameter of each of the domes 641 and 643.

In some implementations, the upper plate protrusions 641-645 may be parts of the cover upper plate 646 and integrally formed with the frame cover 640. For example, the upper plate protrusions 641-645 may be formed by the pressing process of the frame cover 640. Thus, each of the upper plate protrusions 641-645 may be a fixed part of the cover upper plate 646, and may not move or rotate relative to the cover upper plate 646.

The water stored in the water storage tub 31 is introduced into the lifters 61*a*, 61*b*, 62*a*, 62*b*, 63*a*, and 63*b* through the opening portion. The lifter frame 620 is a structure having one or more of the water flow through-holes 624, and the water introduced into the lifters 61*a*, 61*b*, 62*a*, 62*b*, 63*a*, and 63*b* may reach the water flow discharge holes 646*h* through the water flow through-holes 624.

The washing water introduced into the lifters 61*a*, 61*b*, 62*a*, 62*b*, 63*a*, and 63*b* is raised by the rotation of the washing tub 50 in the state in which the washing water is in the lifters 61*a*, 61*b*, 62*a*, 62*b*, 63*a*, and 63*b*, and the washing water is discharged (or sprayed) through the water flow discharge holes 646*h* in this process.

Referring to FIGS. 2, 3, 10, and 13 to 15, each of the lifters 61*a*, 61*b*, 62*a*, 62*b*, 63*a*, and 63*b* includes a lifter upper plate portion spaced apart from the inner circumferential surface of the drum 51, and a lifter sidewall portion having a lower end adjoining the inner circumferential surface of the drum, and an upper end connected to the lifter upper plate portion, and one or more washing protrusions 603 and 604 are formed on the lifter sidewall portion. The washing protrusions 603 and 604 protrude from an outer surface of the lifter sidewall portion and extend in the form of a ring along the outer surface of the lifter sidewall portion.

In some implementations, the frame cover 640 may include one or more side protrusions (e.g., the washing protrusions 603 and 604) that protrude from the outer surface 640*a* of the frame cover 640 to an outside of the frame cover 640. The side protrusions may extend along and surround a circumference of the frame cover 640.

In the case in which each of the lifters 61*a*, 61*b*, 62*a*, 62*b*, 63*a*, and 63*b* includes the lifter frame 620 and the frame cover 640 in the exemplary implementation, the cover upper plate 646 and the cover sidewall 645 of the frame cover 640 are the lifter upper plate portion and the lifter sidewall portion, respectively.

Since each of the washing protrusions 603 and 604 is formed in the form of a ring, the lifters 61*a*, 61*b*, 62*a*, 62*b*, 63*a*, and 63*b* are not easily deformed even when external force is applied in any direction. In particular, in the case in which the frame cover 640 is formed as a plate made of metal (for example, stainless steel) and having a small thickness, sufficient rigidity may be maintained.

The frame cover 640 may include one or more washing protrusions 603 and 604 having a ring shape or one or more washing rings protruding from the outer surface of the cover sidewall 645. The plurality of washing protrusions 603 and 604 may be disposed in parallel with one another. In the exemplary implementation, two washing protrusions 603 and 604 are provided, but the present disclosure is not necessarily limited thereto. In the case in which the frame cover 640 is made of metal, the washing protrusions 603 and 604 may be formed by pressing.

Each of the washing protrusions 603 and 604 has a shape corresponding (or similar) to the contour of the cover sidewall 645, and the washing protrusion may protrude to a predetermined height from the cover sidewall 645. Since the contour of the cover sidewall 645 decreases upward, among the washing protrusions 603 and 604, the washing protrusion that is positioned at an upper side is smaller than the other washing protrusion.

A frictional force applied between the laundry and the washing protrusions 603 and 604 generates an effect of rubbing the laundry, thereby improving washing power. In addition, because the washing protrusions 603 and 604 assist in the operation of lifting up the laundry, physical force (for example, force for lifting up or striking the laundry) of a level as in the related art may be applied to the laundry even when the height of each of the lifters 61*a*, 61*b*, 62*a*, 62*b*, 63*a*, and 63*b* is decreased to be smaller than that in the related art.

Figure 14:
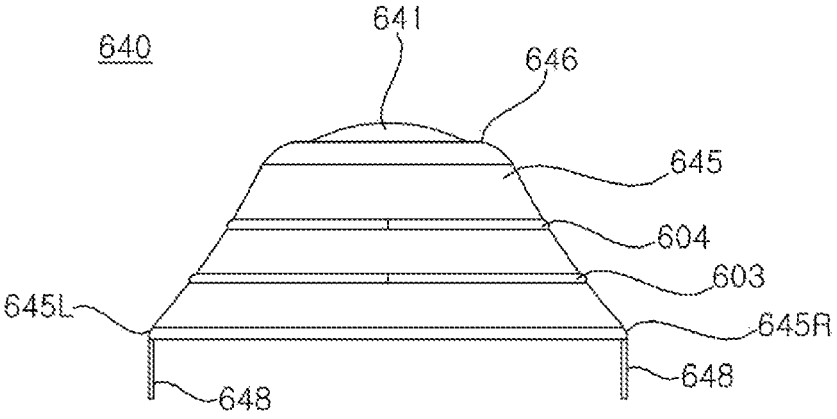
FIG. 14 is a front view of the frame cover.
Figure 15:
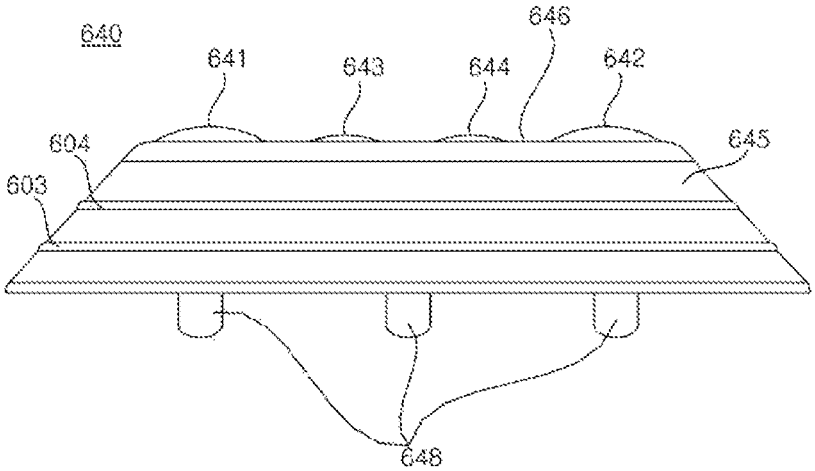
FIG. 15 is a side view of the frame cover.

The frame cover 640 may be coupled to the lifter frame 620. Referring to FIGS. 2 and 3, one or more coupling tabs 648 may be formed at the lower end of the frame cover 640. As illustrated in FIG. 14, the coupling tabs 648 may be formed at a left side 645L or a right side 645R at the lower end when the frame cover 640 is viewed from the front side. The left side 645L and the right side 645R may be straight sections extending in the front-rear direction.

Figure 8:
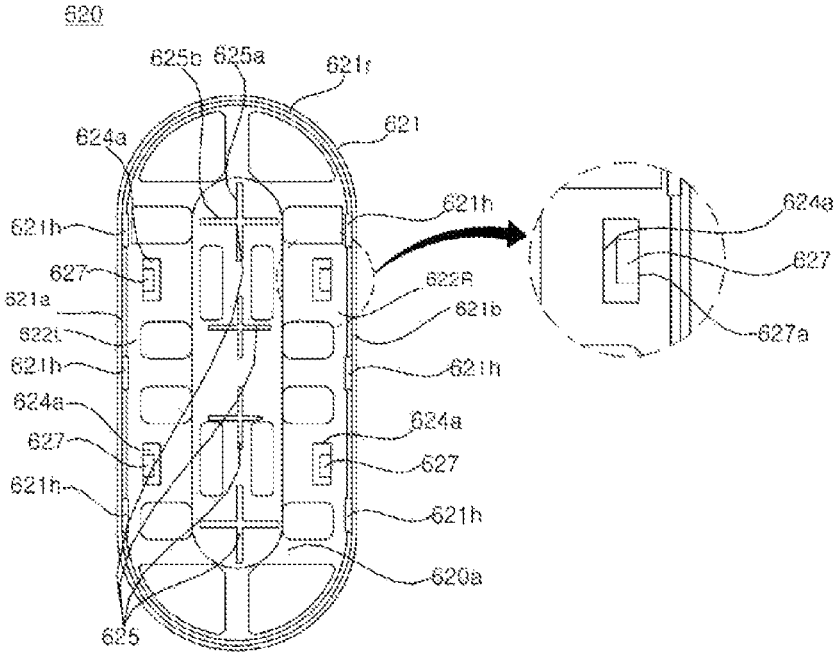
FIG. 8 is a top plan view showing an example of a lifter frame.
Figure 9:
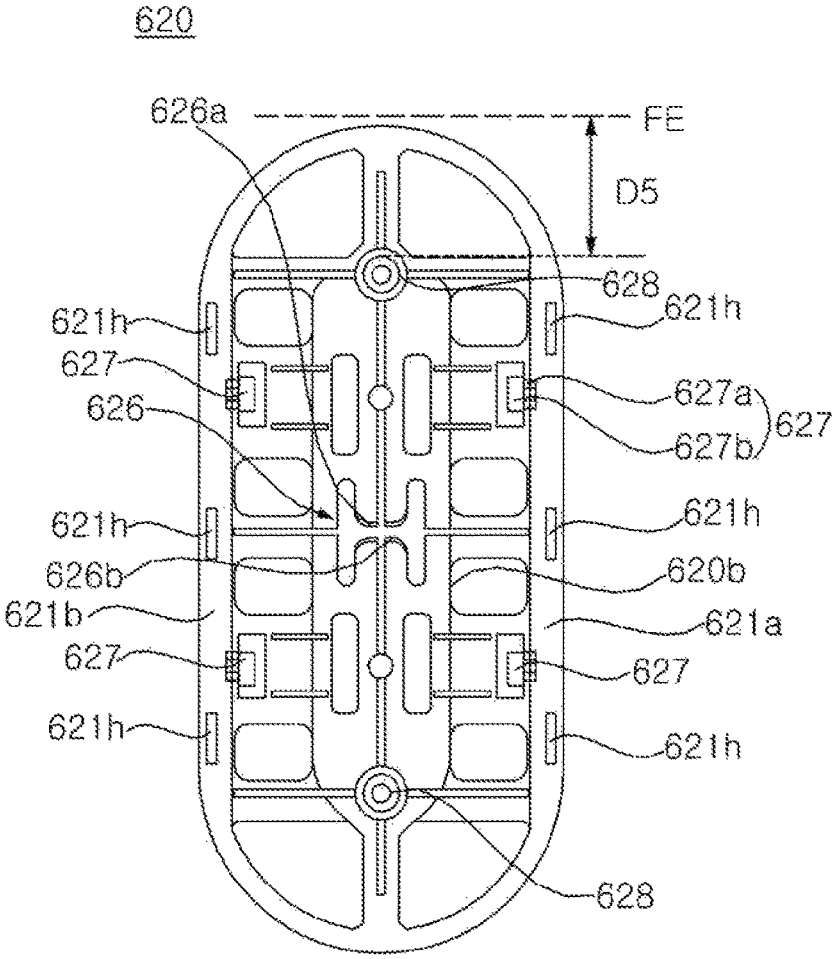
FIG. 9 is a bottom plan view of the lifter frame.

Referring to FIGS. 8 and 9, tab binding ports 621*h*, through which the coupling tabs 648 pass from above, may be formed in the lifter frame 620. The tab binding ports 621*h* may be formed at positions corresponding to the coupling tabs 648, respectively. A coupling tab 648 passes through the tab binding port 621*h*, and the passing portion of the coupling tab 648 is bent and caught by a rim of the tab binding port 621*h* (or a bottom surface of the frame base 621), such that the lifter frame 620 and the frame cover 640 may be coupled to each other.

In some examples, the seating groove 621*r*, which corresponds to the lower end of the frame cover 640, may be formed in the frame base 621 of the lifter frame 620. The lower end of the frame cover 640 may be inserted and seated in the seating groove 621*r*. In this case, the tab binding port 621*h* may be formed in the seating groove 621*r*.

Hereinafter, a structure in which the lifter frame 620 and the drum 51 are coupled to each other will be described.

Referring to FIGS. 8, 9, 11, and 12, one or more insertion protrusions 627 may be formed on each of the front lifters 61*a*, 62*a*, and 63*a* and/or the rear lifters 61*b*, 62*b*, and 63*b*. Further, referring to FIGS. 5A to 7B, the drum 51 may have mounting slots 511*a*1 in a first group G1 and mounting slots 511*a*2 in a second group G2. Each of the groups G1 and G2 may include the one or more mounting slots 511*a*1(1) to 511*a*1(4). Here, the 'group' is a set of mounting slots and may include one or a plurality of mounting slots.

The mounting slots 511*a*1 in the first group G1 and the mounting slots 511*a*2 in the second group G2 may include a number of the mounting slots 511*a*1(1) to 511*a*1(4) and 511*a*2(1) to 511*a*2(4) that corresponds to the number of the one or more insertion protrusions 627. That is, in the case in which the mounting slots in the first group G1 and the second group G2 are used to install the front lifters 61*a*, 62*a*, and 63*a*, the number of mounting slots 511*a*1 in the first group G1 and the number of mounting slots 511*a*2 in the second group G2 may correspond to the number of insertion protrusions 627 provided on each of the front lifters 61*a*, 62*a*, and 63*a*.

Likewise, depending on the implementation, in the case in which the mounting slots in the first group G1 and the second group G2 are used to install the rear lifters 61*b*, 62*b*, and 63*b*, the number of mounting slots 511*a*1 in the first group G1 and the number of mounting slots 511*a*2 in the second group G2 may correspond to the number of insertion protrusions 627 provided on each of the rear lifters 61*b*, 62*b*, and 63*b*.

The one or more insertion protrusions 627 formed on each of the front lifters 61*a*, 62*a*, and 63*a* or the rear lifters 61*b*, 62*b*, and 63*b* may be selectively fastened to the mounting slots 511*a*2 in the first group G1 or the second group G2. The position at which the lifter is installed may be determined depending on whether the one or more insertion protrusions 627 formed on each of the lifters 61*a*, 62*a*, 63*a*, 61*b*, 62*b*, and 63*b* are inserted into the mounting slots that constitute any one of the first group G1 or the second group G2.

Hereinafter, the example in which the mounting slots 511*a*, which constitute the first group G1 and the second group G2, are used to install the front lifters 61*a*, 62*a*, and 63*a* will be described, but the mounting slots may be formed in the same manner in order to install the rear lifters 61*b*, 62*b*, and 63*b*.

Figure 6A:
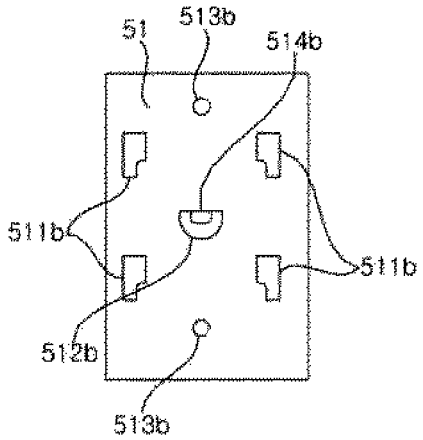
FIG. 6A is an enlarged view showing a part of the drum corresponding to part A in FIG. 5A.
Figure 6B:
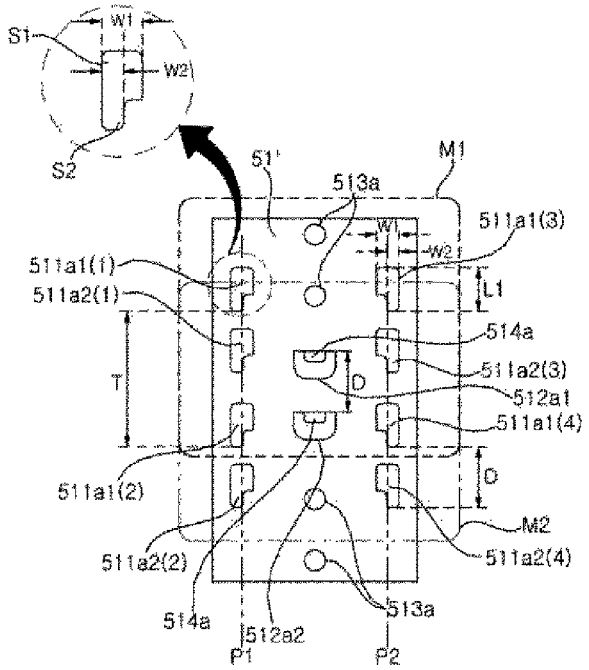
FIG. 6B is an enlarged view showing a part of the drum corresponding to part B in FIG. 5A.

The mounting slots 511*a*2 in the second group G2 are formed in a region shifted rearward within a range in which the mounting slots 511*a*2 in the second group G2 partially overlap the mounting slots 511*a*1 in the first group G1. In FIGS. 6A and 6B, a first region M1 indicates a region in which the mounting slots 511*a*1 in the first group G1 are formed, and a second region M2 indicates a region in which the mounting slots 511*a*2 in the second group G2 are formed. Hereinafter, as illustrated in FIGS. 6A and 6B, the mounting slots 511*a*2 in the second group G2 are disposed rearward from the mounting slots 511*a*1 in the first group G1.

In some implementations, the first group G1 of one or more mounting slots may be defined in a first area of the drum, and the second group G2 of one or more mounting slots in a second area of the drum, where the second area is disposed rearward relative to the first area and overlaps with at least a portion of the first area of the drum.

For example, the first area may be the first region M1 that defines six mounting slots: a pair of front mounting slots in the first group G1; a pair of front mounting slots in the second group G2 disposed rearward relative to the pair of front mounting slots in the first group G1; and a pair of rear mounting slots in the first group G1. The second area may be the second region M2 that defines six mounting slots: the pair of front mounting slots in the second group G2; the pair of rear mounting slots in the first group G1 disposed rearward relative to the pair of front mounting slots in the second group G2; and a pair of rear mounting slots in the second group G2.

The pair of front mounting slots in the second group G2 may be disposed between the pair of front mounting slots in the first group G1 and the pair of rear mounting slots in the first group G1. The first area and the second area may overlap each other in the axial direction of the drum 51. The pair of front mounting slots in the second group G2 and the pair of rear mounting slots in the first group G1 may be disposed in the overlapped area of the first and second areas.

Figure 5A:
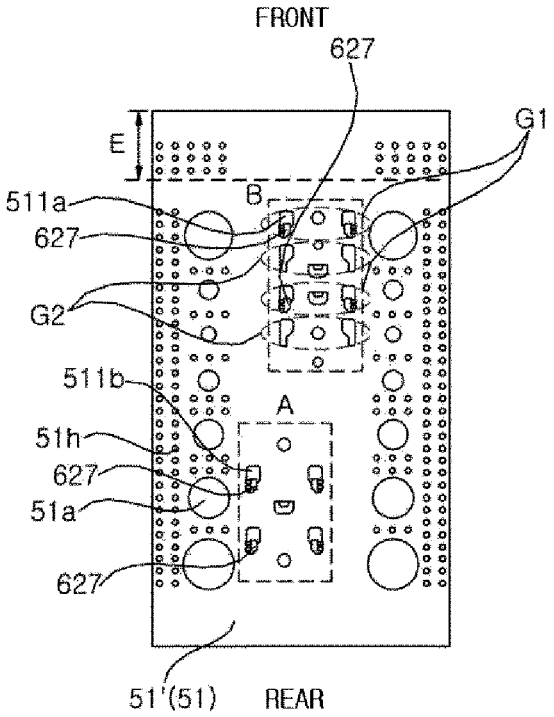
FIG. 5A is a view illustrating an example of a raw material cut to manufacture a large-capacity drum.

Referring to FIGS. 5A to 7B, the mounting slots 511*a*2 in the second group G2 are spaced apart from the mounting slots 511*a*1 in the first group G1 in the rearward direction at a predetermined distance D. Therefore, when the insertion protrusions 627 are installed in the mounting slots 511*a*1 in the first group G1, each of the front lifters 61*a*, 62*a*, and 63*a* is positioned further forward by a distance D in comparison with a case in which the insertion protrusions 627 are installed in the mounting slots 511*a*2 in the second group G2. As illustrated in FIGS. 5A and 5B, the metal plate of the large-capacity drum 51 further extends forward by a distance E in comparison with a case in which the drum is the small-capacity drum. In the case of the large-capacity drum (FIG. 5A), the front lifters 61*a*, 62*a*, and 63*a* are installed by using the mounting slots 511*a*1 in the first group G1, such that the front lifters 61*a*, 62*a*, and 63*a* may be installed relatively further forward in comparison with the case in which the drum is the small-capacity drum (FIG. 5B). Therefore, the laundry positioned in the region corresponding to the distance E may easily come into contact with the front lifters 61*a*, 62*a*, and 63*a* while the drum 51 rotates.

The mounting slots 511*a* in the respective groups G1 and G2 may be disposed in rows in the front-rear direction. Particularly, the mounting slots 511*a* in each of the groups G1 and G2 are disposed in two rows. Further, when the entire configuration is viewed without distinguishing the groups, the mounting slots 511*a* may be arranged along common reference lines extending in the front-rear direction. In some examples, the mounting slots are disposed on two straight lines parallel to each other.

In more detail, the mounting slots 511*a*1 in the first group G1 may include two or more first mounting slots 511*a*1(1) and 511*a*1(2) arranged at a first interval T in a first row P1 extending in the front-rear direction. Furthermore, the mounting slots 511*a*1 in the first group G1 may further include two or more first mounting slots 511*a*1(3) and 511*a*1(4) arranged at the first interval T in a second row P2 parallel to the first row P1.

The mounting slots 511*a*2 in the second group G2 may include two or more second mounting slots 511*a*2(1) and 511*a*2(2) arranged in the first row P1 at positions shifted, by a second interval D smaller than the first interval T, rearward from the mounting slots 511*a*1 in the first group G1.

Furthermore, the mounting slots 511*a*2 in the second group G2 may further include two or more second mounting slots 511*a*2(3) and 511*a*2(4) arranged in the second row P2 at positions shifted, by the interval T, rearward from the mounting slots 511*a*1 in the first group G1.

Hereinafter, the mounting slots 511*a*1 and 511*a*2, which can be used to install the front lifters 61*a*, 62*a*, and 63*a*, are defined as being in a front lifter installation group, and the mounting slots 511*b* (see FIG. 6A), which can be used to install the rear lifters 61*b*, 62*b*, and 63*b*, are defined as being in a rear lifter installation group.

The plurality of front or rear lifters 61*a*, 62*a*, 63*a*, 61*b*, 62*b*, and 63*b* may be disposed in a circumferential direction of the drum 51, such that the plurality of front lifter installation groups may be disposed in the circumferential direction, and likewise, the plurality of rear lifter installation groups may also be disposed in the circumferential direction.

Hereinafter, the mounting slot belonging to the front lifter installation group is referred to as the front mounting slot 511*a*, and the mounting slot belonging to the rear lifter installation group is referred to as the rear mounting slot 511*b*.

Referring to FIGS. 8 to 12, the insertion protrusion 627 may protrude from the frame base 621. The insertion protrusion 627 may include a vertical portion 627*a* (see FIG. 11) protruding downward from the bottom surface of the frame base 621, and a catching portion 627*b* bent in the horizontal direction from the vertical portion 627*a*. The catching portion 627*b* may protrude toward the inside of the ring-shaped frame base 621 when viewed from above.

Figure 11:
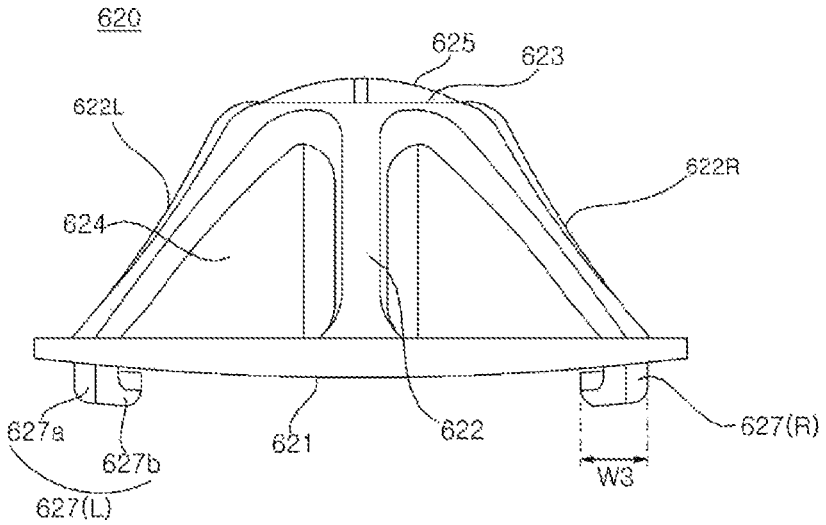
FIG. 11 is a front view showing the lifter frame.
Figure 12:
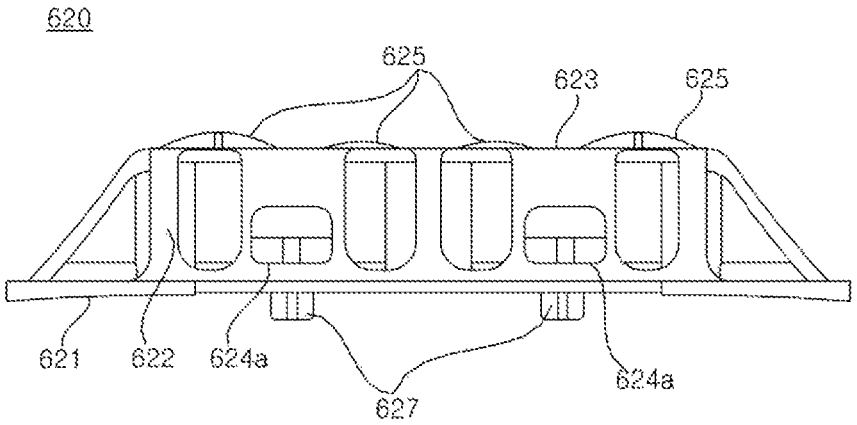
FIG. 12 is a side view of the lifter frame.

As illustrated in FIG. 11, the insertion protrusions 627 may be formed at left and right sides of the frame base 621, respectively, when the lifter frame 620 is viewed from the front side. Two or more insertion protrusions 627 may be formed along one side of the frame base 621 (or in the front-rear direction).

Specifically, the insertion protrusion 627(L) formed at the left side of the frame base 621 may include the catching portion 627*b* which is bent rightward. In some examples, the insertion protrusion 627(R) formed at the right side of the frame base 621 may include the catching portion 627*b* which is bent leftward.

Referring to FIGS. 6A and 6B, each of the mounting slots 511*a* and 511*b* may be shaped to have a length L1 in the approximately front-rear direction of the drum 51. Each of the mounting slots 511 and 511*b* may include an insertion section S1 having a predetermined width W1, and a binding section S2 extending rearward or forward from the insertion section S1 and having a smaller width (W2<W1) than the insertion section S1. In the exemplary implementation, the binding section S2 extends rearward from a rear end of the insertion section S1, but the present disclosure is not necessarily limited thereto. In some examples, the binding section S2 may extend forward from a front end of the insertion section S1.

Figure 20A:
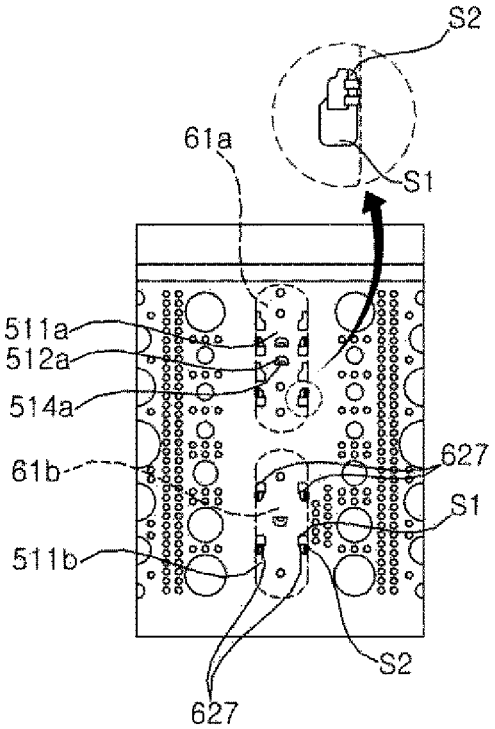
FIGS. 20A and 20B are views illustrating a modified example in which lifters are disposed.
Figure 20B:
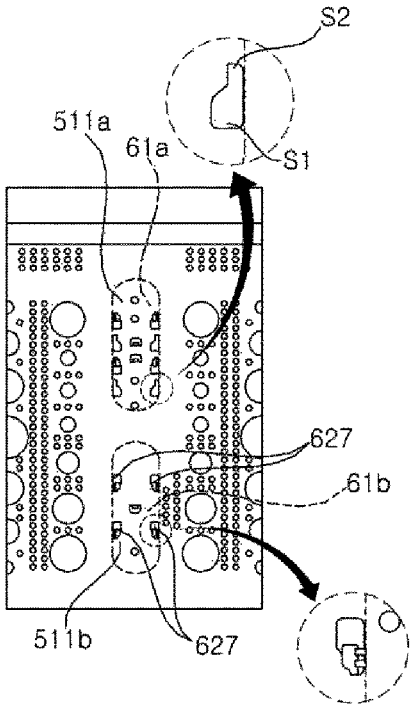

In some implementations, as illustrated in FIGS. 20A and 20B, to be described below, the binding section S2 of the front mounting slot 511*a* may extend forward from the front end of the insertion section S1, and the binding section S2 of the rear mounting slot 511*b* may extend rearward from the rear end of the insertion section S1.

In some examples, referring to FIGS. 5A to 7B, when installing the lifter frame 620 in the drum 51, the insertion protrusion 627 of the lifter frame 620 passes through the insertion section S1, and the lifter frame 620 is pushed rearward, such that the vertical portion 627*a* is moved forward along the binding section S2, and thus the catching portion 627*b* is positioned below the binding section S2. In this case, since the bottom surface of the frame base 621 is in close contact with the inner circumferential surface of the drum 51, and a width W3 (see FIG. 11) of the catching portion 627*b* is larger than the width W2 of the binding section S2, the catching portion 627*b* cannot pass through the binding section S2 from the lower side to the upper side.

Referring to FIGS. 8 to 11, the frame sidewall 622 may include a sidewall left portion 622L having a lower end connected to a left side 621*a* of the frame base 621, and a sidewall right portion 622R having a lower end connected to a right side 621*b* of the frame base 621. At least one of the sidewall left portion 622L or the sidewall right portion 622R may define an acute angle with respect to the frame base 621. Particularly, at least one of the sidewall left portion 622L or the sidewall right portion 622R may be symmetric with each other when viewed from the front side.

The frame sidewall 622 may have a mold ejection port 624*a* formed at a position corresponding to the insertion protrusion 627 when the lifter frame 620 is viewed vertically downward from above. The mold ejection port 624*a* may be formed in at least one of the sidewall left portion 622L or the sidewall right portion 622R.

The lifter frame 620 may be formed by injection molding. In this case, the mold may include an upper mold that forms the upper surface of the lifter frame 620, and a lower mold that forms the lower surface of the lifter frame 620.

The upper surface of the insertion protrusion 627 may be formed by the upper mold. Since the insertion protrusion 627 is positioned at the lower side of the frame sidewall 622, an opening portion, through which a portion of the upper mold defining the upper surface of the insertion protrusion 627 may pass during the process of opening the mold, needs to be formed in a region that overlaps the insertion protrusion 627 in a direction in which the upper mold is opened on the frame sidewall 622 (or a vertically upward direction from the frame base 621) so that a mold portion of the upper mold, which forms the upper surface of the insertion protrusion 627 (particularly, the upper surface of the catching portion 627*b*), may be moved upward (or so that the upper mold may be withdrawn without undercutting during the process of opening the mold), and the mold ejection port 624*a* is the opening portion.

As illustrated in FIG. 8, when the lifter frame 620 is viewed vertically downward from above (hereinafter, referred to as 'a plan view of the lifter frame'), the catching portion 627*b* of the insertion protrusion 627 is positioned in the mold ejection port 624*a* (or overlaps the mold ejection port 624*a*). In some cases, in the plan view of the lifter frame, an outer periphery of the catching portion 627*b* is spaced apart from a rim of the mold ejection port 624*a*, excluding the portion connected to the vertical portion 627*a*.

Referring to FIGS. 9 and 10, a catching protrusion 626 may be formed on at least one of the front lifters 61*a*, 62*a*, and 63*a* or the rear lifters 61*b*, 62*b*, and 63*b*. The catching protrusion 626 may protrude downward from the concave inner surface 620*b* of the lifter frame 620.

Referring to FIGS. 6A and 6B, the opening portions 512*a* and 512*b*, into which the catching protrusions 626 are inserted, may be formed in the drum 51. The pair of opening portions 512*a*1 and 512*a*2 for installing the front lifters 61*a*, 62*a*, and 63*a* may be spaced apart from one another by an interval D in the front-rear direction.

The catching protrusion 626 is selectively inserted into any one of the pair of opening portions 512*a*1 and 512*a*2 depending on whether the insertion protrusions 627 are inserted into the mounting slots 511*a*1 in the first group G1 or the mounting slot 511*a*2 in the second group G2.

Catching tabs 514*a* and 514*b*, which each come into contact with (or are caught by) the lower end of the catching protrusion 626, may be formed on rims of the opening portions 512*a* and 512*b*. The catching tabs 514*a* and 514*b* may come into contact with the lateral surfaces of the catching protrusions 626 in the opening portions 512*a* and 512*b*, thereby restricting lateral movement of the catching protrusions 626.

In some examples, the positions of the catching tabs 514*a* and 514*b* may be determined based on the relative positions of the mounting slots 511*a* and 511*b* with respect to the insertion section S1 of the binding section S2. That is, as illustrated in FIGS. 6A and 6B, when the binding section S2 is positioned rearward from the insertion section S1, the catching tabs 514*a* and 514*b* are positioned in a first concave portion 626*a* at the front side of the catching protrusions 626. The catching tabs 514*a* and 514*b* may extend rearward from the front end of the opening portion 512 to restrict the movement of the catching protrusions 626 when the catching protrusion 626 is about to move forward (that is, the insertion protrusion 627 is about to move from the binding section S2 to the insertion section S1).

In some implementations, like the mounting slot 511*a* illustrated in FIGS. 20A and 20B, when the binding section S2 is positioned forward from the insertion section S1, the catching tabs 514*a* and 514*b* are positioned in a second concave portion 626*b* at the rear side of the catching protrusions 626. The catching tabs 514*a* and 514*b* may extend forward from the rear end of the opening portion 512 to restrict the movements of the catching protrusions 626 when the catching protrusion 626 is about to move rearward (that is, the insertion protrusion 627 is about to move from the binding section S2 to the insertion section S1).

The catching tabs 514*a* and 514*b* may be bent at a predetermined angle to the outside of the drum 51 based on the portion connected to the rims of the opening portions 512*a* and 512*b*. The lateral surfaces of the catching protrusions 626 may come into contact with the catching tabs 514*a* and 514*b* even in the state in which the catching protrusions 626 are not inserted into the opening portions 512*a* and 512*b*.

When the lifter frame 620 is about to move (that is, about to move in a direction opposite to a direction in which the lifter frame 620 is installed) such that the vertical portion 627*a* moves from the binding section S2 to the insertion section S1, the movement is restricted as the catching tabs 514*a* and 514*b* interfere with the lower ends of the catching protrusions 626.

Referring to FIG. 9, at the lower end of the catching protrusion 626, the first concave portion 626*a* may be formed at a side facing the catching tabs 514*a* and 514*b*. In the state in which the lifter frame 620 has been completely installed, the catching tabs 514*a* and 514*b* may be positioned in the first concave portion 626*a*.

At the lower end of the catching protrusion 626, the second concave portion 626*b* may be further formed at a side opposite to the first concave portion 626*a*. When the lifter frame 620 is installed in a state in which the front and rear sides of the lifter frame 620 are changed, the catching tabs 514*a* and 514*b* may be positioned in the second concave portion 626*b*.

Referring to FIG. 9, fastening bosses 628 may be formed on at least one of the front lifters 61*a*, 62*a*, and 63*a* or the rear lifters 61*b*, 62*b*, and 63*b*. The fastening boss 628 may protrude downward from the inner surface 620*b* of the lifter frame 620. The fastening boss 628 may extend from the frame upper plate 623. Two or more fastening bosses 628 may be provided to be spaced apart from one another in the front-rear direction.

Referring to FIGS. 5A to 6B, fastening holes 513*a* and 513*b* may be formed in the drum 51. The fastening holes 513*a* and 513*b* may include a first fastening hole 513*a*1 formed at a position corresponding to the fastening boss 528 when the insertion protrusion 627 of the lifter frame 620 is installed in the mounting slot 511*a*1 in the first group G1, and a first fastening hole 513*a*1 formed at a position corresponding to the fastening boss 528 when the insertion protrusion 627 of the lifter frame 620 is installed in the mounting slot 511*a*2 in the second group G2. The pair of first fastening holes 513*a*1(1) and 513*a*1(2) are provided to correspond to the pair of fastening bosses 528, and the second fastening holes 513*a*2 including a pair of second fastening holes 513*a*2(1) and 513*a*2(2) may be provided.

Figure 7A:
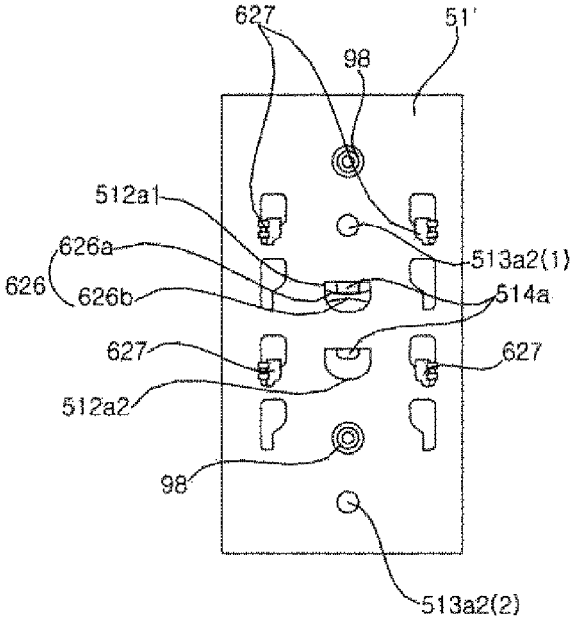
FIG. 7A is an enlarged view showing part B in FIG. 5A.
Figure 7B:
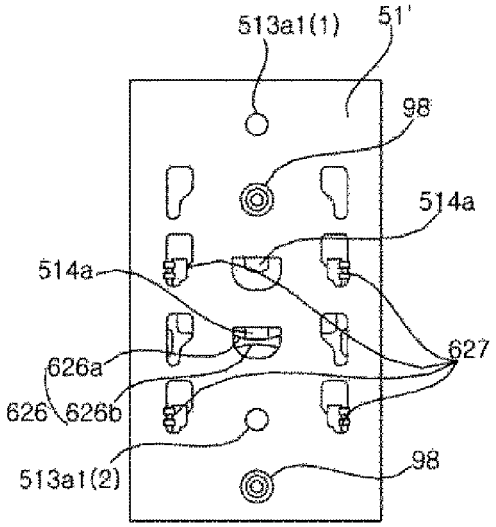
FIG. 7B is an enlarged view showing part C in FIG. 5B.

Referring to FIGS. 7A and 7B, the fastening boss 628 may be selectively fastened to the first fastening hole 513*a*1 or the second fastening hole 513*a*2 by a predetermined fastening member (hereinafter, for exemplary purposes, a screw 98) based on whether the insertion protrusion 627 is inserted into the mounting slot 511*a*1 in the first group G1 or the mounting slot 511*a*2 in the second group G2.

In the state in which the insertion protrusion 627 is inserted into the mounting slot 511*a* and the lifter frame 620 is temporarily assembled, the screw 98 passes through the fastening hole 513*a* from the outside of the drum 51 and is then fastened to the fastening boss 628, such that the lifter frame 620 may be completely installed.

In some examples, as described above, as illustrated in FIG. 7A or FIG. 7B, the installation position of the lifter frame 620 may vary depending on whether the insertion protrusion 627 is inserted into the mounting slot 511*a*1 or the mounting slot 511*a*2. In any case, the mounting slots 511*a*1 and 511*a*2, the opening portions 512*a*1 and 512*a*2, and the fastening holes 513*a*1 and 513*a*2 are hidden by the frame cover 640 in the state in which the lifter is completely installed. That is, the mounting slots 511*a*1 and 511*a*2, the opening portions 512*a*1 and 512*a*2, and the fastening holes 513*a*1 and 513*a*2 are positioned inside the frame cover 640, and thus are not exposed to the inside of the drum 51.

In other words, in the state in which the at least one insertion protrusion 627 provided on each of the lifters 61*a*, 62*a*, 63*a*, 61*b*, 62*b*, and 63*b* is fastened to the mounting slot (for example, 511*a*1) in any one group (for example, G1) among the mounting slots 511*a* in the first group G1 and the second group G2, the mounting slot (for example, 511*a*2) in the other group (for example, G2) may be hidden inside the drum 51 by the lifter.

In more detail, in the state in which the at least one insertion protrusion 627 provided on each of the front lifters 61*a*, 62*a*, and 63*a* is inserted into the mounting slot in any one group (for example, G1) of the first group G1 and the second group G2, the front end (FE) (see FIG. 4) of each of the front lifters 61*a*, 62*a*, and 63*a* may be positioned forward from the mounting slots 511*a*1(1) to 511*a*1(4) and 511*a*2(1) to 511*a*2(4) belonging to the first group G1 and the second group G2. Here, the front end FE may be the front end of the frame cover 640.

In addition, the rear end of each of the front lifters 61*a*, 62*a*, and 63*a* may be positioned rearward from any of the mounting slots 511*a*1(1) to 511*a*1(4) and 511*a*2(1) to 511*a*2(4) belonging to the first group G1 and the second group G2.

Depending on the point of view, in the state in which the at least one insertion protrusion 627 is inserted into one of the mounting slots 511*a*2(1) to 511*a*2(4) in the second group G2 (see (a) of FIG. 20), a distance D1 from the front end of the drum 51 to the front end FE (see FIG. 4) of each of the front lifters 61*a*, 62*a*, and 63*a* may be shorter than a distance D2 from the front end of the drum 51 to the front end of each of the mounting slots 511*a*1(1) to 511*a*1(4) in the first group G1 (that is, the front end of the mounting slot positioned at the foremost side among the mounting slots in the first group) (D1<D2).

In addition, in the state in which the at least one insertion protrusion 627 is inserted into one of the mounting slots 511*a*1(1) to 511*a*1(4) in the first group G1 (see (b) of FIG. 20), a distance D3 from the front end of the drum 51 to the rear end of each of the front lifters 61*a*, 62*a*, and 63*a* may be longer than a distance D4 from the front end of the drum 51 to the rear end of the mounting slot in the second group G2 (that is, the rear end of the mounting slot positioned at the rearmost side among the mounting slots in the second group) (D3>D4). Since all of the mounting slots 511*a*1(1) to 511*a*1(4) and 511*a*2(1) to 511*a*2(4) used to install the front lifters 61*a*, 62*a*, and 63*a* are positioned between the front ends and the rear ends of the front lifters 61*a*, 62*a*, and 63*a*, the mounting slots may be hidden by being covered by the front lifters 61*a*, 62*a*, and 63*a*.

In some examples, a distance D5 (see FIG. 9) from the front end FE of each of the front lifters 61*a*, 62*a*, and 63*a* to the fastening boss 628 may be longer than the interval D (see FIGS. 6A and 6B) (D5>D). In this case, even in the state in which the fastening boss 628 is coupled to the second fastening hole 513*a*2 (see FIGS. 7A and 7B) (in the exemplary implementation, the state in which the fastening member 98 passes through the second fastening hole 513*a*2 and is fastened to the fastening boss 628), the front end FE of each of the front lifters 61*a*, 62*a*, and 63*a* is positioned forward from the first fastening hole 513*a*1 (see FIGS. 7A and 7B), such that the first fastening hole 513*a*1 is still hidden by each of the front lifters 61*a*, 62*a*, and 63*a*.

Manufacturers of laundry treating apparatuses sometimes produce various types of products having drums having different capacities. For example, a metal plate having the mounting slots 511*a* and 511*b*, the opening portions 512*a* and 512*b*, the fastening holes 513*a* and 513*b*, and the like may be cut out, based on a predetermined standard, into the raw material for drum 51' or drum 51" (see FIGS. 5A and 5B). The metal plate cut out in this manner may be rolled up, and the ends of the raw material may be joined together so as to manufacture the drum 51. In this case, the metal plate may be cut to a predetermined length based on the standard of the drum. In order to manufacture two drums having different lengths, it may be necessary to differently adjust the interval between the front lifters 61*a*, 62*a*, and 63*a* and the rear lifters 61*b*, 62*b*, and 63*b* in accordance with the length of the drum.

Figure 5B:
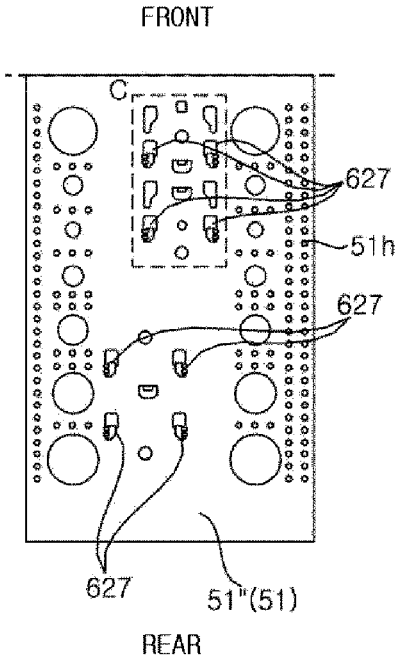
FIG. 5B is a view illustrating an example of a raw material cut to manufacture a small-capacity drum.

For example, as illustrated in FIGS. 5A and 5B, the interval between the front lifters 61*a*, 62*a*, and 63*a* and the rear lifters 61*b*, 62*b*, and 63*b* when the length of the drum 51' is long (see FIG. 5A) needs to be greater than the interval between the front lifters 61*a*, 62*a*, and 63*a* and the rear lifters 61*b*, 62*b*, and 63*b* when the length of the drum 51" is short (FIG. 5B), so that the laundry may be uniformly lifted up by the front and rear lifters 61*b*, 62*b*, and 63*b* even in the case of the large-capacity drum 51.

Therefore, extra mounting slots 511*a* are further formed in the drum 51 in order to adjust the installation position of at least one of the front lifters 61*a*, 62*a*, and 63*a* or the rear lifters 61*b*, 62*b*, and 63*b* in the front-rear direction when the length of the drum is changed.

In some implementations, the extra mounting slots 511*a* are provided to adjust the installation positions of the front lifters 61*a*, 62*a*, and 63*a*, but the present disclosure is not necessarily limited thereto. Depending on exemplary implementations, the extra mounting slots 511*b* may be provided to adjust the installation positions of the rear lifters 61*b*, 62*b*, and 63*b*.

The extra mounting slots 511*a* may be formed in the lifter frame 620 such that the extra mounting slots 511*a* correspond in number to the mounting slots 511*a* (hereinafter, referred to as 'installation slots') into which the insertion protrusions 627 are inserted, and the extra mounting slots 511*a* may be formed at points spaced apart from the respective installation slots at a predetermined distance D in the frontward or rearward direction. The installation position of the lifter frame 620 may be changed by the distance D by separating the insertion protrusion 627 from the mounting slot (for example, 511*a*1) and then inserting the insertion protrusion 627 into the extra mounting slot (for example, 511*a*2).

In some examples, in the exemplary implementation, the extra opening portions 512*a* are provided to adjust the installation positions of the front lifters 61*a*, 62*a*, and 63*a*, but the present disclosure is not necessarily limited thereto. Depending on the implementation, the extra opening portions 512*b* may also be provided to adjust the installation positions of the rear lifters 61*b*, 62*b*, and 63*b*.

In some examples, in the exemplary implementation, the extra fastening holes 513*a* are provided to adjust the installation positions of the front lifters 61*a*, 62*a*, and 63*a*, but the present disclosure is not limited thereto. Depending on the implementation, the extra fastening holes 513*b* may also be provided to adjust the installation positions of the rear lifters 61*b*, 62*b*, and 63*b*.

FIG. 20 illustrates another example of the present disclosure. In order to install the lifter frame 620 by the front mounting slot 511*a*, the lifter frame 620 needs to be pushed forward after the insertion protrusion 627 is inserted into the insertion section S1. In order to install the lifter frame 620 by the rear mounting slot 511*b*, the lifter frame 620 needs to be pushed rearward after the insertion protrusion 627 is inserted into the insertion section S1.

In some examples, in order to separate the lifter frame 620 from the drum 51, the lifter frame 620 is pushed forward or rearward to move the catching portion 627*b* of the insertion protrusion 627 from the binding section S2 and align the catching portion 627*b* with the insertion section S1, and the lifter frame 620 is lifted up, such that the catching portion 627*b* passes through the insertion section S1, and the lifter frame 620 may be separated from the drum 51.

Figure 16A:
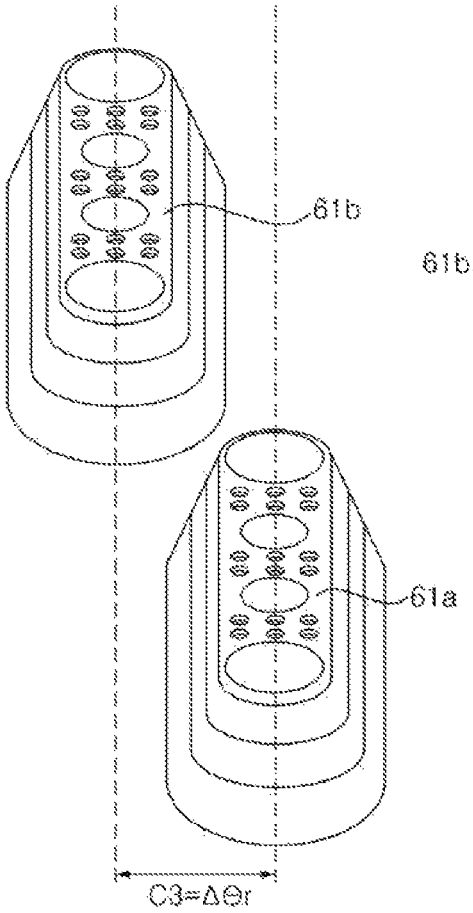
FIGS. 16A and 16B are views illustrating an example of a pair of front and rear lifters illustrated in FIG. 1.
Figure 16B:
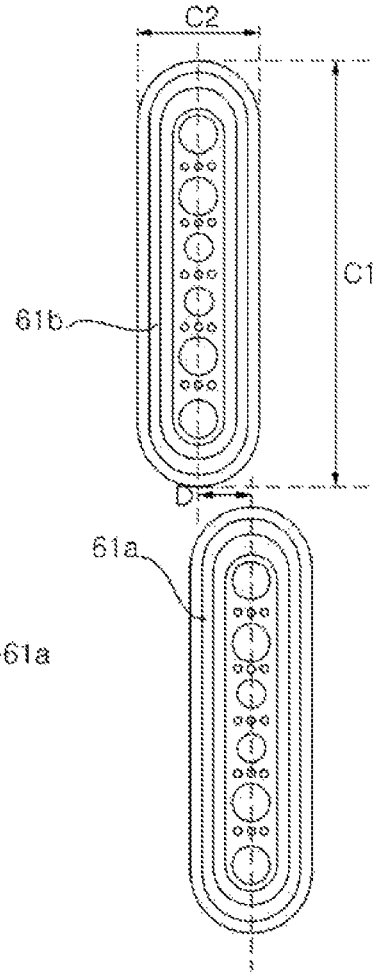
Figure 17:
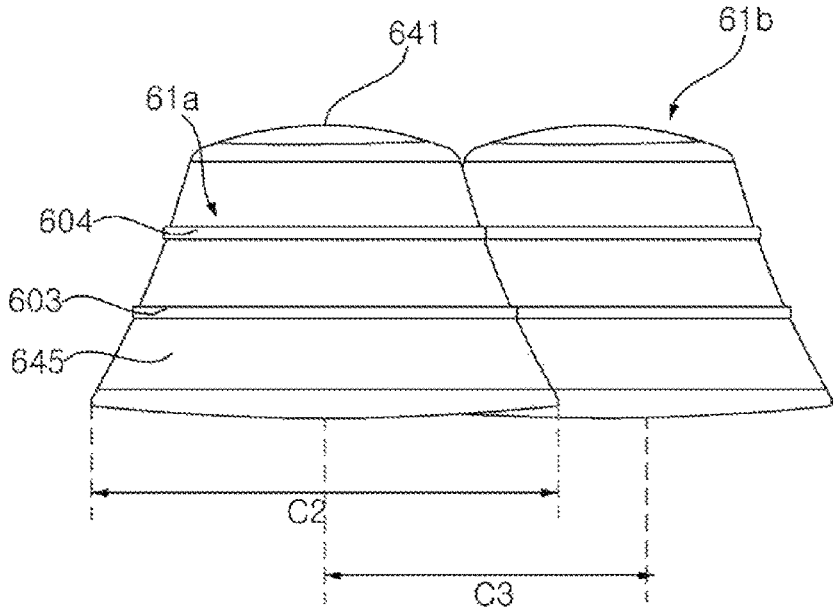
FIG. 17 is a view illustrating the lifters illustrated in FIGS. 16A and 16B when viewed from a front side.
Figure 19:
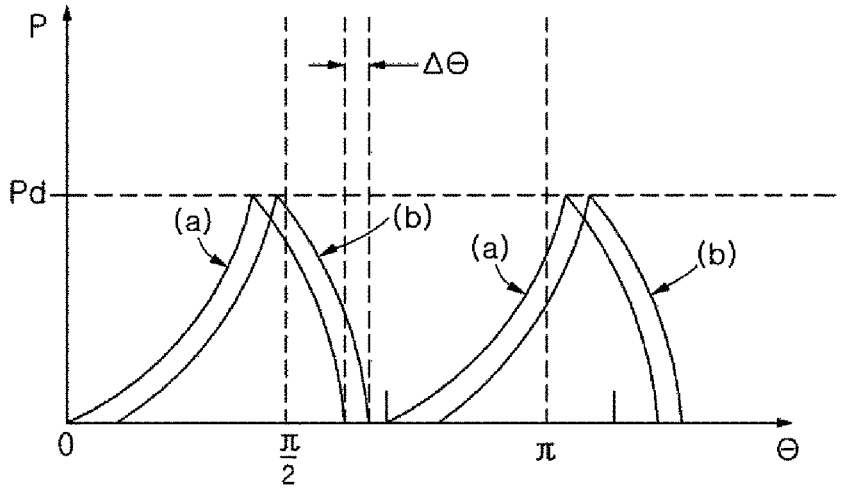
FIG. 19 is a view illustrating an example of a change in height of a first fabric caused by the rear lifter in accordance with a rotation angle of the drum, and a view illustrating an example of a change in height of a second fabric caused by the front lifter that constitutes a set together with the rear lifter.

FIGS. 16A and 16B are views illustrating an example of a pair of front and rear lifters illustrated in FIG. 1. FIG. 17 is a view illustrating the lifters illustrated in FIGS. 16A and 16B when viewed from the front side. FIG. 18A illustrates an example in which the drum illustrated in FIG. 1 is deployed, and FIG. 18B illustrates a developed view of the drum showing the arrangement of the lifters according to another example of the present disclosure. FIG. 19 is a view (a) illustrating a change in height of a first fabric caused by the rear lifter in accordance with a rotation angle of the drum and a view (b) illustrating a change in height of a second fabric caused by the front lifter that constitutes a set together with the rear lifter. Hereinafter, description will be made with reference to FIGS. 16A to 19.

Each of the front lifters 61*a*, 62*a*, and 63*a* is disposed on the inner circumferential surface of the drum 51 and extending in the front-rear direction. The plurality of front lifters 61*a*, 62*a*, and 63*a* are disposed based on the rotation axis O at equal angles.

The rear lifters 61*b*, 62*b*, and 63*b* are disposed on the inner circumferential surface of the drum 51 and positioned rearward from the front lifters 61*a*, 62*a*, and 63*a*. Like the front lifters 61*a*, 62*a*, and 63*a*, the rear lifters 61*b*, 62*b*, and 63*b* are disposed based on the rotation axis O at equal angles.

The rear lifters 61*b*, 62*b*, and 63*b* are disposed to form a predetermined phase angle with the front lifters 61*a*, 62*a*, and 63*a* with respect to the rotation axis O. Here, the 'phase angle' is made by defining, as a rotation angle of the drum 51, a point in time at which the lifters 61*a*, 62*a*, 63*a*, 61*b*, 62*b*, and 63*c* reach a point on the circumference. Assuming that the drum 51 is rotated clockwise CW in the exemplary implementation, the rear lifters 61*b*, 62*b*, and 63*b* reach the same height prior to the front lifters 61*a*, 62*a*, and 63*a* by a degree corresponding to the phase angle $\Delta\theta$.

As illustrated in FIGS. 16A to 17, assuming that each of the lifters 61*a*, 62*a*, 63*a*, 61*b*, 62*b*, and 63*b* has a length C1 extending in the front-rear direction and a width C2 defined in the left-right direction (or a direction orthogonal to the longitudinal direction), a circumferential distance ($C3=\alpha\theta r$, see FIG. 19) corresponding to the phase angle is larger than 0 and equal to or smaller than two times the width C2 in the circumferential direction of each of the front lifters 61*a*, 62*a*, and 63*a*.

Referring to FIGS. 18A and 18B, a no-lifter region SE, in which there is no front lifter or rear lifter, is formed between any one pair of front/rear lifters (for example, 61*a* and 61*b*) and another pair of front/rear lifters (for example, 62*a* and 62*b*) on the inner circumferential surface of the drum 51. The no-lifter region SE may extend from the front end to the rear end of the drum 51.

Specifically, the no-lifter region SE passes between the two adjacent sets of lifters from the front end of the drum 51 and extends to the rear end of the drum 51. Specifically, the no-lifter region SE extends straight from the front end of the drum 51 to the rear end of the drum while passing between the two adjacent front lifters (for example, 61*a* and 62*a*) among the plurality of front lifters 61*a*, 62*a*, and 63*a* and between the two rear lifters 61*b* and 62*b* that each form the phase angle Δθ with each of the two adjacent front lifters 61*a* and 62*a*.

Since the no-lifter region SE extends straight from the front end to the rear end of the drum 51, the laundry may be uniformly distributed to the front and rear regions of the drum 51 in the no-lifter region SE.

Typically, the washing machine detects eccentricity of the drum 51 before performing a spin-drying process, and when the detected eccentricity is within a reference value, the drum is accelerated such that the rotational speed of the drum 51 reaches a predetermined spin-drying speed (or spin-drying RPM). Otherwise, a fabric distribution is performed to change the position of fabrics in the drum 51. The fabric distribution is repeated if the detected eccentricity does not reach the reference value. When the number of times the fabric distribution is repeated reaches a predetermined number of times, it is determined that the fabric distribution has failed, and the spin-drying is stopped.

In the washing machine, a first fabric positioned at the rear side of the drum 51 (that is, the fabric to be lifted up by the rear lifters 61*b*, 62*b*, and 63*b*) and a second fabric positioned at the front side of the drum 51 (that is, the fabric to be lifted up by the front lifters) flow with a time difference (or a phase difference) by the phase angle Δθ formed by the front lifters 61*a*, 62*a*, and 63*a* and the rear lifters 61*b*, 62*b*, and 63*b*, and as a result, the fabric distribution may be more smoothly performed.

More specifically, referring to FIG. 19, when the drum 51 is rotated clockwise CW in a state in which the rear lifters 61*b*, 62*b*, and 63*b* are positioned at a lowest point (θ=0) of the drum 51, the first fabric begins to be lifted up first by the rear lifters 61*b*, 62*b*, and 63*b*, and then the second fabric begins to be lifted up by the front lifters 61*a*, 62*a*, and 63*a* after the time corresponding to the phase angle Δθ has passed.

Assuming that the fabrics roll ($\theta<\pi/2$) and that a position P at which the fabric lifted up by the lifters 61*a*, 62*a*, 63*a*, 61*b*, 62*b*, and 63*b* falls is a position Pd, the first fabric lifted up by the rear lifters 61*b*, 62*b*, and 63*b* reaches the position (or height) Pd and falls first, and then the second fabric lifted up by the front lifters 61*a*, 62*a*, and 63*a* reaches the position Pd and falls.

The first fabric and the second fabric move with a time difference without forming lumps, and thus may be evenly distributed. As a result, it is possible to reduce the number of times the fabric distribution is repeated, reduce the instances of failure to enter the spin-drying stage, and reduce the overall washing time including the spin-drying time.

In addition, since the fabrics flow with a phase difference when the fabrics roll or tumble, friction or collision between the fabrics caused by the relative movement occurs more frequently, such that contamination may be more effectively removed by the washing operation (that is, washing power is improved).

In some examples, FIGS. 20A and 20B are views illustrating a modified example in which the lifters are disposed, in which FIG. 20A illustrates a small-capacity drum, and FIG. 20B illustrates a large-capacity drum. Referring to FIGS. 20A and 20B, one set of front lifters 61*a*, 62*a*, and 63*a* and rear lifters 61*b*, 62*b*, and 63*b* may be disposed in a row in the front-rear direction. That is, the front lifters 61*a*, 62*a*, and 63*a* and the rear lifters 61*b*, 62*b*, and 63*b*, which constitute one set, may be arranged on the same line without being spaced apart from one another in the circumferential direction.

Figure 21:
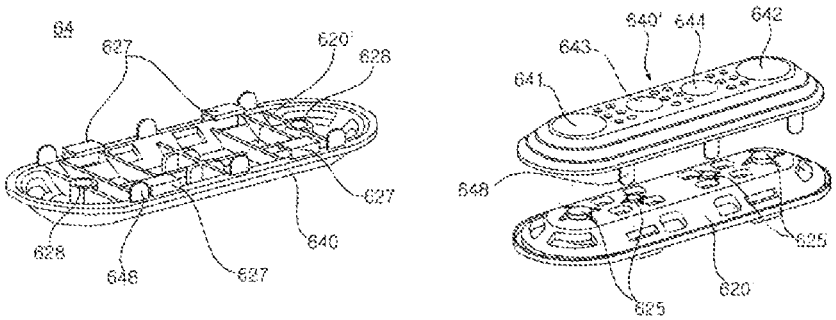
FIG. 21 illustrates another example of a lifter.

FIG. 21 is a view illustrating another example of a lifter. The example illustrated in FIG. 21 includes a lifter 64 including a lifter frame 620' and a frame cover 640' slightly different in shape from those in the above-mentioned exemplary implementations, but similar in detailed configuration to those in the above-mentioned exemplary implementations. Therefore, constituent elements identical to the constituent elements according to the above-described exemplary implementations will be assigned the same reference numerals, and a specific description thereof will be omitted.

While the disclosure has been explained in relation to its implementations, it is to be understood that various modifications thereof will become apparent to those skilled in the art upon reading the specification. Therefore, it is to be understood that the disclosure disclosed herein is intended to cover such modifications as fall within the scope of the appended claims.

What is claimed is:

1. A laundry treating apparatus comprising:

a tub configured to receive washing water;

a drum disposed in the tub and configured to receive laundry, the drum being configured to rotate about a rotation axis that extends in a front-rear direction of the laundry treating apparatus; and a lifter disposed on an inner circumferential surface of the drum and configured to rotate about the rotation axis based on rotation of the drum, the lifter comprising:

a lifter frame installed on the inner circumferential surface of the drum and made of synthetic resin, the lifter frame having a frame sidewall that protrudes toward the rotation axis and extends in the front-rear direction, and a frame cover that is coupled to a lower portion of the lifter frame and protrudes radially inward from the lower portion of the lifter frame, the frame cover being made of metal, wherein the frame cover comprises:

a cover upper plate spaced apart from the inner circumferential surface of the drum, a cover sidewall that extends from the cover upper plate to the lower portion of the lifter frame, the cover sidewall being spaced apart from the frame sidewall by a predetermined separation space configured to commutate the washing water between the cover sidewall and the frame sidewall, and a side protrusion that protrudes from an outer surface of the cover sidewall and defines a closed curve surrounding an entirety of an outer circumference of the cover sidewall in a plan view toward the inner circumferential surface of the drum.

2. The laundry treating apparatus of claim 1, wherein the side protrusion comprises a plurality of side protrusions that respectively extend along circumferences of the cover sidewall and that are spaced apart from each other.

3. The laundry treating apparatus of claim 2, wherein the plurality of side protrusions extend in parallel to one another on the cover sidewall.

4. The laundry treating apparatus of claim 3, wherein the plurality of side protrusions comprise:

a first side protrusion that has a first ring shape; and a second side protrusion that has a second ring shape and that extends in parallel to the first side protrusion.

5. The laundry treating apparatus of claim 4, wherein the second side protrusion is disposed between the cover upper plate and the first side protrusion, and wherein a circumferential length of the second side protrusion is greater than a circumferential length of the first side protrusion.

6. The laundry treating apparatus of claim 1, wherein the frame cover defines a recess at an inner surface of the cover upper plate facing the lifter frame.

7. The laundry treating apparatus of claim 1, wherein the lifter comprises:

a plurality of front lifters disposed at a front portion of the drum and arranged along a circumferential direction of the drum; and a plurality of rear lifters disposed at rear sides of the plurality of front lifters and arranged along the circumferential direction of the drum, wherein the plurality of front lifters and the plurality of rear lifters define a plurality of groups of lifters, each group of the plurality of groups comprising a pair of lifters including one of the plurality of front lifters and one of the plurality of rear lifters.

8. The laundry treating apparatus of claim 7, wherein each of the plurality of rear lifters in the plurality of groups defines a phase angle in the circumferential direction of the drum with respect to one of the plurality of front lifters in the pair of lifters.

9. The laundry treating apparatus of claim 8, wherein each of the plurality of rear lifters in the plurality of groups is configured to, based on the drum rotating in a clockwise direction, reach a point on a circumference of the tub before the one of the plurality of front lifters reaches the point on the circumference of the tub.

10. The laundry treating apparatus of claim 8, wherein a circumferential distance corresponding to the phase angle between a front lifter and a rear lifter in a same group among the plurality of groups is greater than zero and equal to a width of the front lifter in the circumferential direction.

11. The laundry treating apparatus of claim 8, wherein a circumferential distance corresponding to the phase angle between a front lifter and a rear lifter in a same group among the plurality of groups is larger than zero and less than a width of the front lifter in the circumferential direction.

12. The laundry treating apparatus of claim 8, wherein a circumferential distance corresponding to the phase angle between a front lifter and a rear lifter in a same group among the plurality of groups is larger than zero and less than two times of a width of the front lifter in the circumferential direction.

13. The laundry treating apparatus of claim 7, wherein a front lifter and a rear lifter in a same group among the plurality of groups are arranged along the front-rear direction and overlap with each other in a circumferential direction of the drum.

14. The laundry treating apparatus of claim 1, wherein the side protrusion has a ring shape surrounding the outer surface of the cover sidewall.

15. The laundry treating apparatus of claim 1, wherein the cover sidewall surrounds the frame sidewall.

16. The laundry treating apparatus of claim 1, wherein the lifter frame comprises a frame base that faces the inner circumferential surface of the drum and supports the frame cover, the frame base defining a seating groove that receives an end of the cover sidewall to thereby define the predetermined separation space between the cover sidewall and the frame sidewall.

17. The laundry treating apparatus of claim 16, wherein at least a portion of the frame base extends into the predetermined separation space.

18. The laundry treating apparatus of claim 1, wherein the frame cover comprises an upper plate protrusion that protrudes from an outer surface of the cover upper plate toward the rotation axis, the frame cover defining a recess that is recessed into the upper plate protrusion from an inner surface of the cover upper plate facing the lifter frame.

19. The laundry treating apparatus of claim 18, wherein the lifter frame comprises:

a frame upper surface that faces the inner surface of the cover upper plate; and a spacer that protrudes from the frame upper surface and is inserted to the recess of the frame cover.

20. The laundry treating apparatus of claim 2, wherein lengths of the plurality of side protrusions along the circumferences of the cover sidewall are different from each other.

* * * * *